US007684725B2

(12) United States Patent
Suyama et al.

(10) Patent No.: US 7,684,725 B2
(45) Date of Patent: Mar. 23, 2010

(54) EXPOSURE DEVICE AND IMAGE FORMING APPARATUS

(75) Inventors: Kouhei Suyama, Fukuoka (JP); Yuuzou Kawano, Fukuoka (JP); Kazuo Nishimura, Osaka (JP)

(73) Assignee: Panasonic Corporation, Osaka (JP)

( * ) Notice: Subject to any disclaimer, the term of this patent is extended or adjusted under 35 U.S.C. 154(b) by 272 days.

(21) Appl. No.: 11/782,156

(22) Filed: Jul. 24, 2007

(65) Prior Publication Data

US 2008/0025752 A1 Jan. 31, 2008

(30) Foreign Application Priority Data

Jul. 25, 2006 (JP) ..... 2006-201582

(51) Int. Cl.
*G03G 21/00* (2006.01)
*G03G 13/04* (2006.01)
*B41J 2/385* (2006.01)

(52) U.S. Cl. ..... 399/98; 347/129; 347/138

(58) Field of Classification Search ..... 399/98, 399/177, 92, 346; 347/129, 138, 152
See application file for complete search history.

(56) References Cited

U.S. PATENT DOCUMENTS

| | | | | |
|---|---|---|---|---|
| 6,308,024 | B1 | 10/2001 | Nakayama et al. | |
| 6,505,021 | B2 | 1/2003 | Shibuya et al. | |
| 7,386,248 | B2 * | 6/2008 | Park et al. | 399/98 X |
| 7,403,732 | B2 * | 7/2008 | Shimazu et al. | 399/98 X |

FOREIGN PATENT DOCUMENTS

| | | |
|---|---|---|
| JP | 64-082067 | 3/1989 |
| JP | 4-278970 | 10/1992 |
| JP | 6-149019 | 5/1994 |
| JP | 7-120995 | 5/1995 |
| JP | 7-325459 | 12/1995 |
| JP | 2544078 | 5/1997 |
| JP | 9-265224 | 10/1997 |
| JP | 10-048945 | 2/1998 |
| JP | 10-048949 | 2/1998 |
| JP | 10-198162 | 7/1998 |
| JP | 11-265118 | 9/1999 |
| JP | 2000-275931 | 10/2000 |
| JP | 2001-138574 | 5/2001 |
| JP | 2001-281970 | 10/2001 |
| JP | 2001-281994 | 10/2001 |
| JP | 2001-324870 | 11/2001 |

(Continued)

OTHER PUBLICATIONS

English language partial translation of JP 2544078.

(Continued)

*Primary Examiner*—Sandra L Brase
(74) *Attorney, Agent, or Firm*—Greenblum & Bernstein, P.L.C.

(57) ABSTRACT

An image forming apparatus includes an image carrier that carries a latent image; an exposure device, which includes a light source and an optical member, for focusing, on the image carrier, light emitted by the light source that is used to form a latent image on the image carrier; and a developing device, for developing the latent image. A dust prevention member that contacts the image carrier is arranged for the exposure device.

31 Claims, 8 Drawing Sheets

FOREIGN PATENT DOCUMENTS

| | | |
|---|---|---|
| JP | 2001-343814 | 12/2001 |
| JP | 2001-350326 | 12/2001 |

OTHER PUBLICATIONS

English language Abstract of JP 10-048949.
English language Abstract of JP 64-082067.
English language Abstract of JP 4-278970.
English language Abstract of JP 6-149019.
English language Abstract of JP 7-120995.
English language Abstract of JP 7-325459.
English language Abstract of JP 9-265224.
English language Abstract of JP 10-048945.
English language Abstract of JP 10-198162.
English language Abstract of JP 11-265118.
English language Abstract of JP 2000-275931.
English language Abstract of JP 2001-138574.
English language Abstract of JP 2001-281994.
English language Abstract of JP 2001-281970.
English language Abstract of JP 2001-324870.
English language Abstract of JP 2001-343814.
English language Abstract of JP 2001-350326.

* cited by examiner

EXPOSURE DEVICE AND IMAGE FORMING APPARATUS

BACKGROUND OF THE INVENTION

The present invention relates to printers, as well as to other types of electrophotographic image forming apparatuses, that provide visible images developed using toner or another powder, and to an exposure device, which is employed for an electronic image forming apparatus, that uses light to irradiate, and thus expose, a photosensitive member, which serves as an image carrier.

As described in patent document 1 and patent document 2, there are certain problems that are encountered with an electrophotographic image forming apparatus, such as a laser printer or an LED (Light-Emitting Diode) printer that uses colored toner, or another powder, to develop images, because during the development process the toner is dispersed internally and becomes attached to various operating parts of the apparatus. In addition to the problems caused by toner, like problems are encountered that are the result of the dispersal, like powder, of so-called lint produced from paper that is used as the print medium to which an image is transferred.

For an image forming apparatus, such as an LED printer, that prepares as a light source for exposure an LED array formed of a plurality of LEDs, and that to expose a photosensitive member, i.e., an image carrier, employs an exposure device that sequentially switches the LEDs on, the pitch of the LED array is generally almost equal to the pitch of the pixels (corresponding to the resolution) used to form an image. Thus, in order to reduce the size of the image forming apparatus, the exposure device is attached close to the photosensitive member, i.e., the image carrier. On the other hand, there is a considerably higher probability, in this case, that toner will be attached to the surface of a lens, the optical member of the exposure device, compared with the arrangement employed for a laser printer, wherein the exposure device is arranged at a specified distance from the image carrier. Therefore, for this type of image forming apparatus, problems occasioned by the dispersal and attachment of toner, paper lint and other dust-like particles to the optical member is more serious.

To resolve this problem, according to patent document 1, in which is described an embodiment for an LED printer, an image forming apparatus is disclosed wherein a cover, in which an opening is provided, is attached to the distal end of an exposure device; wherein, for the cover, a 1 mm or narrower space is set for a gap between the width of the opening and the width of a light beam and for a gap between the distal end of the exposure device and a photosensitive drum; and wherein a predetermined potential is applied to the distal end of the exposure device.

According to the description presented in Japanese Utility Model No. 2,544,078, the tiny gap, which is formed between the photosensitive drum and the exposure device, and an electrostatic force, which is used for charging toner, are employed to prevent toner, dispensed by a developing device, from entering the opening of an exposure device.

According to JP-A-10-048949, in order to prevent the inward dispersion of toner from the ends of a developing roller shaft, a technique is disclosed that provides for urethane foam sealing members to be formed along the faces of a support member and a case body that are opposite a photosensitive drum and along the portions of the faces of the support member and the case body that are opposite each other, and the sealing members are sandwiched by the photosensitive drum, the case body and the support member to provide a tight seal for a developing area.

According to the arrangement disclosed in Japanese Utility Model No. 2,544,078, a predetermined voltage is applied to the distal end of the cover, and by employing the electrostatic force to charge toner, the charged toner, when dispersed, reacts with and is repelled by the distal end, and is prevented from entering the opening (in the cover) of the exposure device. However, since the LED printer head is provided along almost the entire length (corresponding to the width of a printing sheet) of the barrel of the photosensitive drum, even though the gap between the cover and the barrel of the photosensitive drum is tiny, the total space between the cover, up to the distal end, and the photosensitive drum is quite large. Therefore, the entry of toner through the gap can not be completely prevented.

Furthermore, the technique disclosed in JP-A-10-048949 is basically intended to prevent the dispersion of toner supplied from the developing device. Even if the dispersion of toner from an area being developed can be prevented, by using a developing device for which the above described seal has been provided, a powder similar to talc (such as so-called paper lint) that is rubbed off a recording sheet will still be floating inside the image forming apparatus. This powder can be attached to the light output face of an exposure device, such as the LED, and the phenomenon can not be completely prevented that produces the deterioration of the image quality.

SUMMARY OF THE INVENTION

The present invention resolves these conventional problems, and one objective of this invention is to prevent toner, paper lint and other scattered dust-like particles from entering the exposure optical system of an image forming apparatus.

To achieve this objective, an image forming apparatus includes:

an image carrier for carrying a latent image;

an exposure device including a light source, and an optical member for focusing light emitted by the light source on the image carrier for forming a latent image on the image carrier;

a developing device for developing the latent image; and a dust prevention member provided to the exposure device to contact the image carrier.

With this arrangement, the attachment of dust-like powder to the external surface of the optical member can be prevented.

Figure 1:
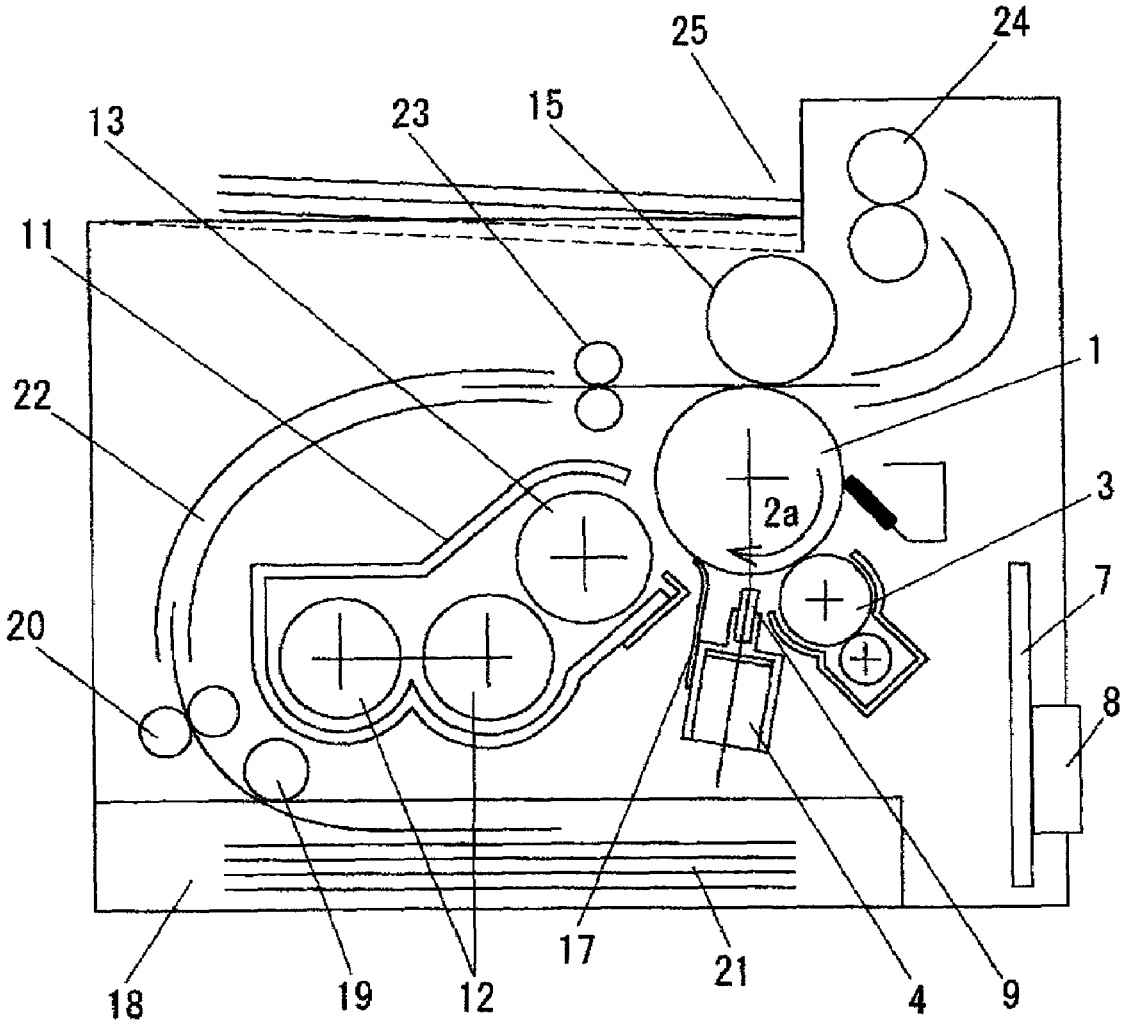
FIG. 1 is a schematic cross sectional view of an image forming apparatus according to a first embodiment of the present invention.

1: photosensitive member
3: charging roller
4: exposure device
5: axis
6: substrate
7: controller
8: external interface
9: lens array
10: light axis
11: developing device
12: supply roller
13: developing roller
14: blade
15: transfer roller
16: cleaning unit
17: toner protection sheet
18: sheet cassette
19: pickup roller
20: feed roller
21: printing sheet
22: conveying path
23: registration roller
24: fixing roller
25: discharge tray
26: toner protection sheet
27: toner protection sheet
29*a*, 29*b*: end
30: image forming area
31, 31*a*, 31*b*: toner protection sheet
32: photosensitive member
33: toner protection gap member
34: exposure device
35: light source cover rib
36: toner protection pressure spring
37: toner protection rib
38: toner protection sheet
39*a*, 39*b*: air passage
40: lens array
41: toner protection sheet
42: main body
43: flexible photosensitive-member-contacting protection member
44: gap adjustment member
45: capillary member
46: metal plate
46*a*: metal plate end
47: electric circuit

DETAILED DESCRIPTION OF THE PREFERRED EMBODIMENTS

The preferred embodiments of the present invention will now be described while referring to the accompanying drawings.

First Embodiment

An electrophotographic image forming apparatus according to a first embodiment of the present invention has a printing resolution of 600 dpi, and prints paper sizes up to A4.

FIG. 1 is a schematic cross sectional view of the image forming apparatus of the first embodiment. In the following explanation, the image forming apparatus is referred to simply as "the apparatus".

In FIG. 1, a photosensitive member 1 is a drum, the charged surface of which is exposed, from which all charges are removed. Thereafter, the outer wall of the barrel is exposed to a variety of distributed charges, and a latent image is formed thereon that is subsequently developed, using toner, to obtain a toner image.

Figure 2A:
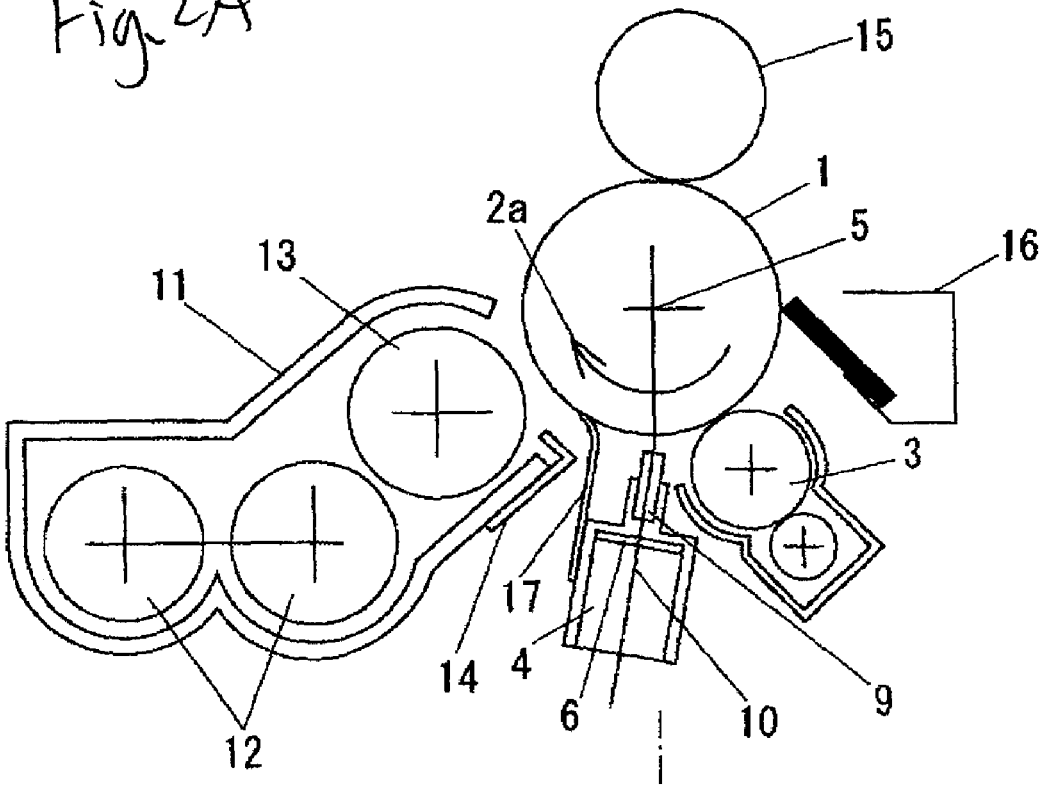
FIG. 2A is an enlarged cross sectional view of the essential portion of the periphery of the photosensitive member of the image forming apparatus according to the first embodiment.

FIG. 2A is an enlarged cross sectional view of the essential portion of the periphery of the photosensitive member 1 of the apparatus according to the first embodiment. And FIG. 2B is an enlarged bottom view of the essential portion of the periphery of the photosensitive member 1 of the apparatus according to the first embodiment.

Figure 2B:
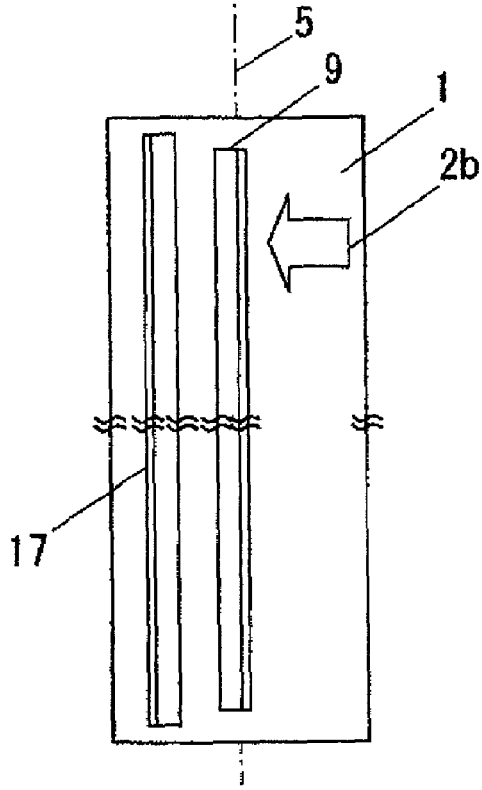
FIG. 2B is an enlarged cross sectional view of the essential portion of the periphery of the photosensitive member of the image forming apparatus according to the first embodiment.

It should be noted that only the photosensitive member 1, a lens array and a protection sheet, which will be described later, are shown in FIG. 2B.

While referring to FIGS. 2A and 2B, as the photosensitive member 1 rotates in the direction indicated by arrows 2*a* and 2*b*, a latent image is formed and is developed using toner.

A charging roller 3 uniformly charges the surface of the barrel of the photosensitive member 1 using a charge having a constant strength.

Based on image data that enters the apparatus through an external interface 8 (see FIG. 1), an exposure device 4 irradiates light to expose the surface of the photosensitive member 1. A plurality of organic electroluminescence elements (4,960 elements, consonant with the length of the short side of A4 paper; hereinafter abbreviated as "organic EL elements"), which serve as light sources, are arranged at a pitch of 600 dpi in the direction of an axis 5 of the photosensitive member 1, and this long organic EL array (not shown) is mounted on a substrate 6. Control for the emission of light by the individual organic EL elements of the organic EL array is provided by a controller 7 (see FIG. 1) of the apparatus.

The controller 7 in FIG. 1 includes a microprocessor, a memory, the external interface 8 and other digital processing circuits. The controller 7 provides control for the operation of the electric devices of the apparatus, and sequentially and selectively turns on organic EL elements, provided for the organic EL array of the exposure device 4, to expose and to scan the surface of the rotating photosensitive member 1. Further, provided at this time is light emission timing control, based on the image data supplied to the apparatus, for the individual organic EL elements, which facilitates the formation, consonant with the image data, of a latent image on the surface of the photosensitive member 1.

A lens array 9, which is an optical member included in the exposure device 4, is located between the organic EL array and the photosensitive member 1, and a plurality of cylindrical imaging lenses (fiber lenses) are disposed among the organic EL array, which consists of closely spaced organic EL elements positioned along the axis 5 of the photosensitive member 1. Light axes 10 of the individual lenses are directed as shown, and light emitted by the organic EL elements of the organic EL array is guided to the barrel face of the photosensitive member 1. The exposure device 4 adjusts the focal lengths of the individual lenses of the lens array 9, and the distal end of the lens array 9 is located near the surface of the photosensitive member 1, so that light emitted by the individual lenses of the lens array 9 can be concentrated on the surface of the photosensitive member 1.

As shown in FIG. 2A, the direction in which the outer wall of the lens array 9 faces the photosensitive member 1, or the direction of the light axis 10 of the light that is output by the lens array 9, is opposite the side on which a developing device 11, which will be described later, is located. That is, in the apparatus, the exposure device 4 is so located that the direction in which light is output by the lens array 9 (the direction of the light axis 10) is not toward the center of the photosensitive member 1, but toward the side opposite that on which the developing device 11 is located. This is because scattered, powder-like dust is prevented from being guided to and entering the optical path, and from being attached to the external surface of the optical member.

From a different viewpoint, it can be said that in accordance with the arrangement of the charging roller 3, the exposure device 4 and the developing device 11 around the photosensitive member 1, the light output face of the exposure device 4 (the lens array 9) is located so it faces the side of the charging roller 3. Further, while focusing on the direction in which the photosensitive member 1 is rotated, it can also be said that the light output face of the exposure device 4 (the lens array 9) is positioned so it faces upward, in the direction opposite that in which the photosensitive member 1 is rotated.

The developing device 11 includes supply rollers 12 and a developing roller 13 that rotate in consonance with the rotation of the photosensitive member 1, and are filled with a developer, toner (a powder). The supply rollers 12 agitate and supply toner to the developing roller 13, and the developing roller 13 employs a blade 14 to adjust the amount of toner applied, while developing a latent image and forming a toner image on the face of the photosensitive member 1. In the first embodiment, powdered toner is employed as the developer; however, instead of powdered toner, a liquid toner may be employed that is prepared by mixing tiny particles of a pigment into a solvent.

A transfer roller 15 grips and presses a printing sheet against the photosensitive member 1 to transfer the toner image to the surface of the printing sheet.

A cleaning unit 16 removes toner remaining on the surface of the photosensitive member 1 after the transfer process has been completed.

A toner protection sheet 17 constitutes an optical path cover, and serves as a dust prevention member to prevent the adhesion of toner and paper lint. The toner protection sheet 17 is a non-conductive plastic sheet made of a material, such as urethane, silicon, chloroprene rubber, styrene butadiene rubber (SBR), nitrile butadiene rubber (NBR), or ethylene propylene rubber (EPDM). In this embodiment, centrifugal deformation of liquid urethane, for example, is performed to obtain a toner protection sheet 17.

As shown in 2A, the toner protection sheet 17 is arranged between the lens array 9 of the exposure device 4 and the developing device 11, and as shown in FIG. 2B, one end, which is attached to the external face of the exposure device 4, extends along the entire length of the lens array 9. In this case, the optical path especially indicates a space through which light, output by the lens array 9, passes (through which light beams pass) when irradiating the surface of the photosensitive member 1. The toner protection sheet 17, which is a dust prevention member for preventing the adhesion of toner and paper lint, is an item having a specific size, with which the side of the optical path, at the least, is separated from other space.

As described above, the image forming apparatus of this embodiment includes: an image carrier (photosensitive member 1), which carries a latent image; the exposure device, which includes light sources (organic EL elements) and an optical member (lens array 9), for focusing light output by the light sources on the image carrier and forming a latent image on the image carrier; and the developing device 11, for developing the latent image. Further, a protective dust member (toner protection sheet 17), which contacts the image carrier (photosensitive member 1) is additionally provided for the exposure device 4.

In the first embodiment, the toner protection sheet 17 is attached to the outer wall of the exposure device 4. Since the purpose for providing the toner protection sheet 17 is to prevent the attachment of dust to the light output face of the exposure device 4, the toner protection sheet 17 may be attached closer to a protected object, e.g., to the lens array 9. With this arrangement, the space defined by the exposure position and the toner protection sheet 17 (and the charging roller 3) is reduced, and the substance of the affect obtained is that scattering outside can be minimized.

According to the technique cited in patent document 2, a toner seal is attached to the developing device 11 to prevent the dispersion of toner from the developing device 11. Since the developing device 11 is made of durable goods, there is a case wherein a toner seal that is not durable may be abandoned at the time the developing device 11 is exchanged. On the other hand, since the exposure device 4 (or the lens array 9 included in this device) is basically-produced on the assumption that it has the same service life length as the image forming apparatus, the toner protection sheet 17 need only be provided for the exposure device 4 as in the image forming apparatus of this invention, so that a reduction in the cost and improved environmental protection can be easily achieved.

Since toner to be attached to the portion other than the exposure device 4 of the image forming apparatus can be reduced by providing a toner seal for the developing device 11, double sealing may be performed, i.e., a toner seal may be provided for the developing device 11, and a toner protection seal 17 may be provided for the exposure device 4.

Figure 3:
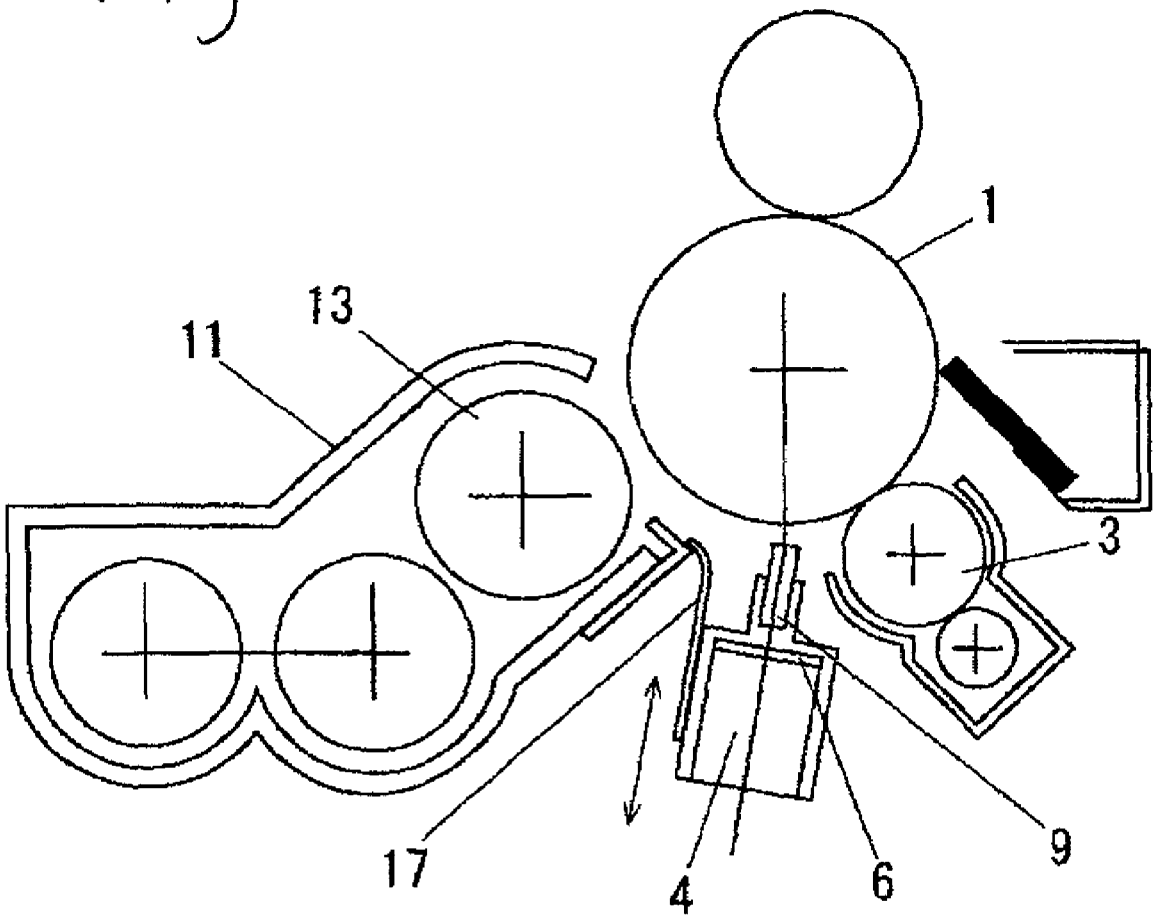
FIG. 3 is an enlarged cross sectional view of the periphery of the photosensitive member at replacement time according to the first embodiment.

FIG. 3 is an enlarged cross sectional view of the essential portion of the periphery of the photosensitive member 1 at the time the photosensitive member 1 is exchanged according to the first embodiment.

Compared with the normal arrangement in FIG. 2 that enables printing, in FIG. 3, for the exchange of the photosensitive member 1, the exposure device 4 can be moved to a position shown and retracted a distance from the photosensitive member 1. At this time, the toner protection sheet 17 attached to the exposure device 4 is also moved, together with the exposure device 4, and the end of the toner protection sheet 17 that normally contacts the upper surface of the photosensitive member 1 is separated from the upper face of the photosensitive member 1. Therefore, the toner protection sheet 17 does not interfere with the exchange of the photosensitive member 1.

The explanation will be continued while again referring to FIG. 1.

In FIG. 1, printing sheets 21 are mounted in a sheet cassette 18.

A pickup roller 19 picks up one printing sheet 21 from the sheet cassette 18, and feeds the sheet 21 to feed rollers 20. Thereafter, the printing sheet 21 fed to the feed rollers 20 is sequentially conveyed along a conveying path 22 to the feed rollers 20, registration rollers 23, a transfer roller 15 and fixing rollers 24.

Along the sheet conveying path 22, the registration rollers 23 are positioned before the transfer roller 15, and when the registration rollers 23 are halted, the conveying of the printing sheet 21 is stopped at that location.

The fixing rollers 24 apply heat and pressure to the printing sheet 21, to which a toner image has been transferred by the transfer roller 15, and by using the heat and pressure, the toner image is fixed to the surface of the printing sheet 21.

A discharge tray 25 is used for the discharge, from the conveying path 22, of the printing sheet 21 to which the toner image has been fixed.

With the above described arrangement, the printing operation of the apparatus will now be described while referring to FIGS. 2A and 2B as well as to FIG. 1.

The apparatus is connected, via the external interface 8 of the controller 7, to a computer (not shown), such as a personal computer, by an electric connection cable. The controller 7 receives and processes printing information (data) output by the computer, and based on the printing information, generates in a memory a bitmap image for a screen (one page).

When printing information from the computer is received by the controller 7, it permits the pickup roller 19 to pick up one of the printing sheets 21 from the sheet cassette 18. And as the feed rollers 20 are rotated, this printing sheet 21 is conveyed to a position in front of the registration rollers 23. At this time, since the rotation of the registration rollers 23 is halted by the controller 7, the conveying of the printing sheet 21 is stopped and its leading edge is positioned at the registration rollers 23.

When the controller 7 has completed the generation of the bitmap image, the controller 7 employs the charging roller 3 to apply a predetermined charge to the photosensitive member 1, which it rotates in the direction indicated by the arrow 2*a* or 2*b*. Furthermore, at this time, the controller 7 sequentially transmits the bitmap data to the exposure device 4 for each raster. On the other hand, the exposure device 4 correlates the bits of the bitmap data, for each raster, with the light emitting devices of the organic EL array, and based on the bit information, controls the emission of light by the light emitting devices, i.e., turns the light emitting devices on or off.

Light emitted by the individual light emitting devices are transmitted to the surface of the photosensitive member 1 by the lens array 9, and in consonance with the contents of the bitmap data, a latent image is formed on this surface. At this time, since the photosensitive member 1 is rotated, as described above, in the direction indicated by the arrow 2*a* or 2*b*, latent images for the individual rasters are formed on the surface of the photosensitive member 1 in the direction indicated by the arrow 2*b* (in order in the direction that is the reverse of that indicated by the arrow 2*b*). Therefore, a corresponding two-dimensional latent image is formed.

Furthermore, since the developing roller 13 and the supply rollers 12 of the developing device 11 are rotated in accordance with the rotation of the photosensitive member 1, toner filling the developing device 11 is agitated by the supply rollers 12, a predetermined amount of the toner is supplied to the developing roller 13, and the developing roller 13 uses this toner to develop the latent image formed on the surface of the photosensitive member 1 and to obtain a toner image.

The controller 7 also controls the timing for starting the rotation of the registration rollers 23 and to convey the printing sheet 21, which was halted when its leading edge had reached the position of the registration rollers 23. Thereafter, the timing at which the printing sheet 21 is conveyed, by rotating the registration rollers 23, and reaches the transfer roller 15 should match the timing at which the toner image, developed on the surface of the photosensitive member 1, reaches the transfer roller 15 through the rotation of the photosensitive member 1. Thus, at the position of the transfer roller 15, the toner image on the surface of the photosensitive member 1 is transferred to the printing sheet 21, and at this time, any residual toner on the photosensitive member 1 that was not transferred to the printing sheet 21 is removed from the surface of the photosensitive member 1 by the cleaning unit 16.

Thereafter, the conveying of the printing sheet 21 to which the toner image has been transferred by the transfer roller 15 is continued, and the toner image is fixed to the surface of the printing sheet 21 by the fixing rollers 24. The image bearing sheet 21 is then discharged to the discharge tray 25.

The toner protection sheet 17 will now be described.

As described above, during the printing operation performed by the apparatus, toner loaded in the developing device 11 is agitated and supplied to the developing roller 13 by the supply rollers 12. Then, at the latent image formed on the surface of the photosensitive member 1, electrostatic force attracts the toner on the developing roller 13 to the latent image, so that a toner image is formed and held on the surface of the photosensitive member 1. Thereafter, the toner forming the toner image on the photosensitive member 1 is transferred to the printing sheet 21 by the transfer roller 15, and the toner image is fixed to a printing sheet by the fixing rollers 24. As described above, until the fixing process if performed by the fixing rollers 24, the state of the toner is that of a powder material that is easily dispersed.

Therefore, as previously described, the toner protection sheet 17, which serves as a dust prevention member in the apparatus, is prepared between the lens array 9 of the exposure device 4 and the developing device 11, and is extended along the entire length of the lens array 9, with one end attached to the external face of the exposure device 4. With the toner protection sheet 17, the dispersion of toner and other powder-like dust to the lens array 9 is blocked, and the attachment of the powder-like dust to the lens face is prevented. Since the toner protection sheet 17 is arranged between the exposure device 4 and the developing device 11, which is a toner supply source, the scale of the toner protection sheet 17 need not be especially increased, and the dispersion of toner to the lens (the lens array 9) of the exposure device 4 can be efficiently prevented.

In the normal state of an apparatus wherein printing has been enabled, one end of the toner protection sheet 17 contacts the surface of the photosensitive member 1, as shown in FIG. 2. In this embodiment, since the toner protection sheet 17 is a non-conductive sheet, which does not move (discharge) charges used to form a latent image on the surface of the photosensitive member 1, the latent image is not destroyed by contacting the toner protection sheet 17.

The toner protection sheet 17 also possesses plasticity, and during printing, as the photosensitive member 1 is rotated, it slides over the surface of the photosensitive member 1, while the shape of the end that contacts the surface is maintained as shown in FIG. 2A. As a result, the contact the end of the toner protection sheet 17 makes with the surface of the photosensitive member 1 is more stable, and when toner from the developing device 11 is dispersed, the toner can be substantially or completely prevented from passing the contact position and reaching the optical path.

In the first embodiment, the entire toner protection sheet 17 is non-conductive; however, part or all of the portion that does not contact the surface of the photosensitive member 1 may be composed of a conductive material.

Further, relative to the conductive portion (a conductive portion of the toner protection sheet 17, or a conductive component, such as a metallic component, that the toner protection sheet 17 contacts, e.g., a metallic support member provided for the toner protection sheet 17), the potential may be equal to a reference potential for the apparatus, i.e., may, so to speak, be grounded to the apparatus, or a floating state potential may be maintained relative to the reference potential of the apparatus (an electric connection to the apparatus may not be established).

Further, for the end of the toner protection sheet 17 that possesses plasticity and that contacts the surface of the photosensitive member 1, the face on the developing device 11 side may be made of a material or may be a member that has a greater specific gravity than has the face on the lens array 9 side. With this arrangement, during the development process, when the surface of the rotating photosensitive member 1 is moved from the lens array 9 side to the developing device 11 side, the raising of the end of the toner protection sheet 17 can be suppressed. Therefore, toner from the developing device 11 that is dispersed is prevented from entering the optical path through a gap that may be formed, between the toner protection sheet 17 and the surface of the photosensitive member 1, by the raising of the toner protection sheet 17. As a result, deterioration in the image quality, accompanied by a reduction in the accuracy of the exposure optical system, can be prevented:

In addition, as shown in FIG. 2B, the toner protection sheet 17 contacts the surface of the photosensitive member 1 parallel to the axis 5 of the photosensitive member 1. However, instead of being parallel to the axis 5 of the photosensitive member 1, the toner protection sheet 17 may contact the surface of the photosensitive member 1 obliquely, relative to the direction (direction indicated by the arrow 2*b*) in which the surface of the photosensitive member 1 is moved while rotating.

Figure 4A:
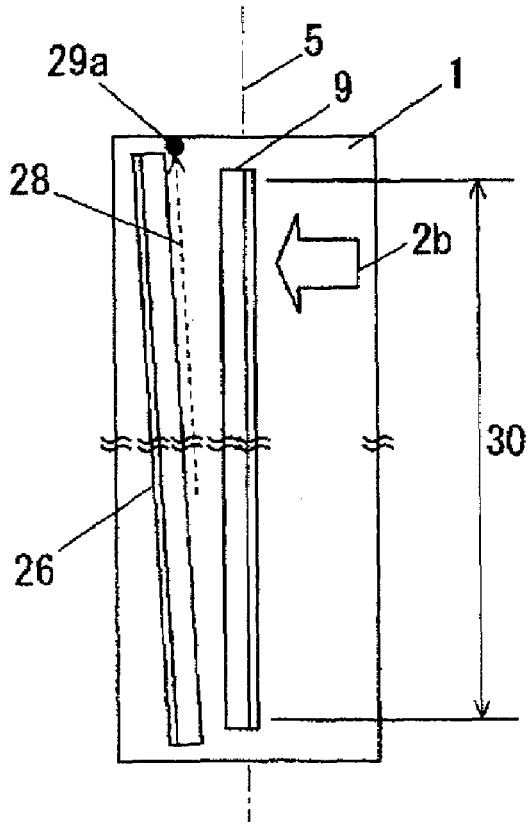
FIG. 4A is a bottom view of the essential portion of toner protection sheets that are obliquely arranged relative to the axial direction of the photosensitive member of the first embodiment.
Figure 4B:
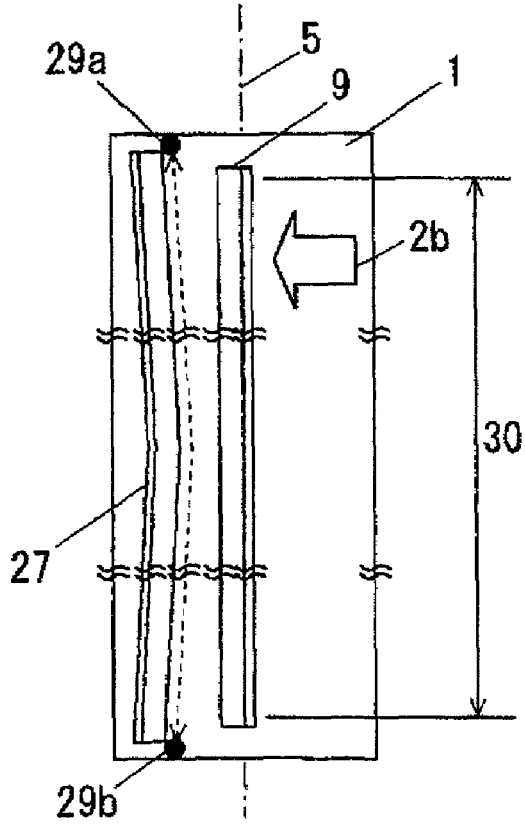
FIG. 4B is a bottom view of the essential portion of the toner protection sheets that are obliquely arranged relative to the axial direction of the photosensitive member of the first embodiment.

FIGS. 4A and 4B are bottom views of the essential portion of a toner protection sheet that is obliquely arranged, relative to the axis 5 of the photosensitive member 1 according to the first embodiment of the invention.

FIGS. 4A and 4B are enlarged schematic views (views taken in the same direction as that in FIG. 2B) of the peripheries of photosensitive members for two example image forming apparatuses that respectively include toner protection sheets 26 and 27. Here, only the photosensitive member 1, the lens array 9 and the toner protection sheet 26 or 27 are shown.

As shown in FIG. 4A, the toner protection sheet 26 is obliquely arranged relative to the axis 5 of the photosensitive member 1, and as shown in FIG. 4B, the toner protection sheet 27 that contacts the surface of the photosensitive member 1 is bent.

In the arrangement in FIG. 4A, even if a substance, such as a powder-like dust, passes the toner protection sheet 26 and enters the optical path (on the exposure device side), when the photosensitive member 1 is rotated and its surface is moved in the direction indicated by the arrow 2*b*, the substance slides (in the direction indicated by an arrow 28) along the obliquely contacting toner protection sheet 26 to one side of the contact end (the side downstream in the direction in which the surface of the photosensitive member 1 is moved). As a result, the substance is discharged to an end 29*a* of the photosensitive member 1.

The same process is performed for the arrangement in FIG. 4B. A substance, such as a powder-like dust, that has passed the toner protection sheet 27 and entered the optical path is discharged to an end 29*a* or to an end 29*b* of the photosensitive member 1.

These arrangements are especially effective for a substance, such as a powder-like dust, present on the surface and in vicinity of the photosensitive member 1. Therefore, since a powder-like dust on an area (called an image forming area) 30 of the surface of the photosensitive member 1, which is related to image forming and which is exposed along the axis 5, is discharged to the end 29*a* or 29*b*; the rate can be reduced at which the powder-like dust may be attached to the lens array 9 in the image forming area 30. In this manner, the amount of powder-like dust, which can cause the quality of an image to be deteriorated, can actually be reduced.

Furthermore, in this embodiment, the toner protection sheet 17 has been arranged between the lens array 9 of the exposure device 4 and the developing device 11. However, toner protection sheets may be so provided that the sides of the optical path are totally separated from other space.

Figure 5:
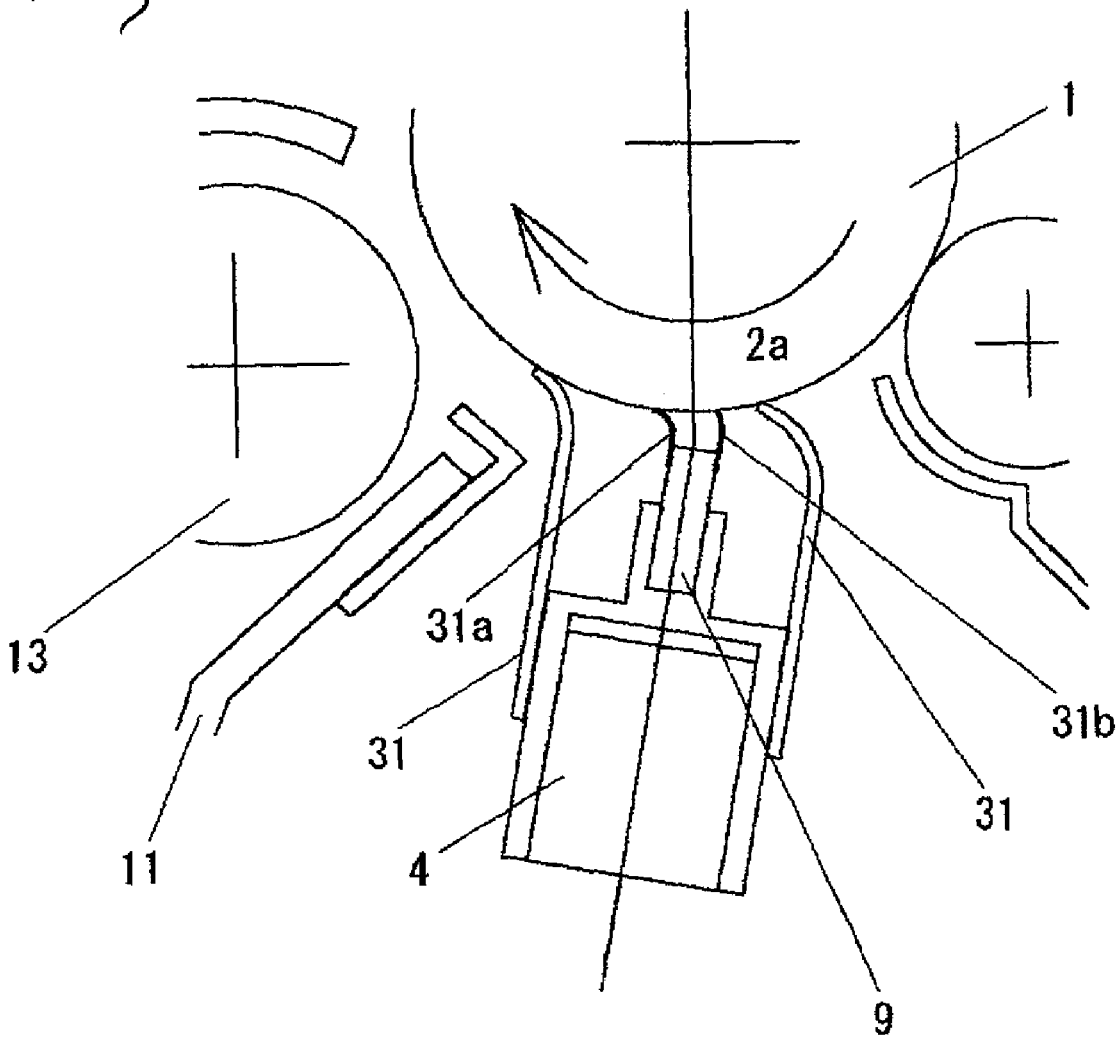
FIG. 5 is an enlarged cross sectional view of the essential portion of the periphery of the photosensitive drum for an example image forming apparatus, wherein toner protection sheets are arranged along the entire side faces of an optical path according to the first embodiment.

FIG. 5 is an enlarged cross sectional view of the essential portion of the periphery of a photosensitive member 1, for an example image forming apparatus according to the first embodiment of the invention, wherein toner protection sheets 31 are provided along the entire sides of an optical path.

While referring to FIG. 5, the toner protection sheets 31 that serve as dust prevention members are arranged on the upstream side and the downstream side of the exposure device 4, in the direction, indicated by the arrow 2*a*, in which the image carrier (the photosensitive member 1) is moved relative to the exposure device 4. That is, to cover the optical path from the sides, the toner protection sheets 31 are provided for the entire sides of the optical path. According to this arrangement, since the optical path is almost closed by the exposure device 4, the photosensitive member 1 and the toner protection sheets 31, a powder-like dust, such as toner, that has been dispersed and is floating in the open space can be almost completely prevented from entering the optical path.

Further, as indicated by thick solid lines in FIG. 5, toner protection sheets 31*a* and 31*b* may be arranged along the lens array 9. And when the toner protection sheets 31 are employed (are arranged along the side faces of the exposure device 4), the longitudinal ends (vertical relative to the paper plane in FIG. 5) of the exposure device 4 are open. However, when the two toner protection sheets 31*a* are arranged along the lens array 9 so they more narrowly cover the optical path, the open ends become much smaller, and the space that includes the optical path can be more effectively enclosed.

In this case, the toner protection sheet 31*b* should be shorter than the toner protection sheet 31*a*, so that the toner protection sheet 31*b* will not be deformed and block the optical path of the light that is output by the lens array 9.

A toner protection member may also be formed that includes the toner protection sheets 31*a* and 31*b* and the longitudinal end (not shown) of the exposure device 4, i.e., a toner protection member may be so formed, using toner protection sheets, that the area surrounding either the exposure device 4 or the lens array 9 is completely covered (in this case, the member can be called an optical cover, rather than a toner protection sheet), and this member may be brought into contact with the photosensitive member 1.

As described above, in the arrangement for the image forming apparatus of the first embodiment, an organic EL light emitting array is employed as the light source for the exposure device 4, and the exposure device 4 is moved near the photosensitive member 1 that serves as an image carrier. Although a toner protection sheet 17, 26, 27 or 31 that serves as a dust prevention member is provided and contacts the surface of the photosensitive member 1, charges placed on the surface of the photosensitive member 1 when forming a latent image are not disturbed (discharged). Thus, the latent image is not destroyed, and the outer face and the vicinity of the lens array 9, which is an optical member, can be blocked off from the surrounding area. Moreover, toner dispersed from the developing device 11, and paper lint and other powder-like dust dispersed by the system for conveying the printing sheet 21 can be substantially prevented from entering the optical path by passing across the surface of the photosensitive member 1. In addition, the attachment of powder-like dust to the external face of the lens array 9 (the external faces of the imaging lenses of the lens array 9) can be suppressed. As described above, an image forming apparatus can be provided that can prevent the deterioration of image quality, which is accompanied by a reduction in the accuracy of the exposure optical system.

Second Embodiment

In the first embodiment, an example image forming apparatus has been described that includes a toner protection sheet that contacts the surface of a photosensitive member. In a second embodiment of the present invention, an example image forming apparatus (hereinafter called the apparatus of the second embodiment) will be described that includes a toner protection sheet that does not contact the surface of a photosensitive member.

The main configuration of the apparatus is almost the same as that of the image forming apparatus of the first embodiment, except for the toner protection sheet and the structure of a related portion. The image forming operation of the apparatus is also the same as that of the first embodiment. Therefore, only the structure and the operation that differ from those of the image forming apparatus of the first embodiment will be described while referring to FIG. 1.

Figure 6A:
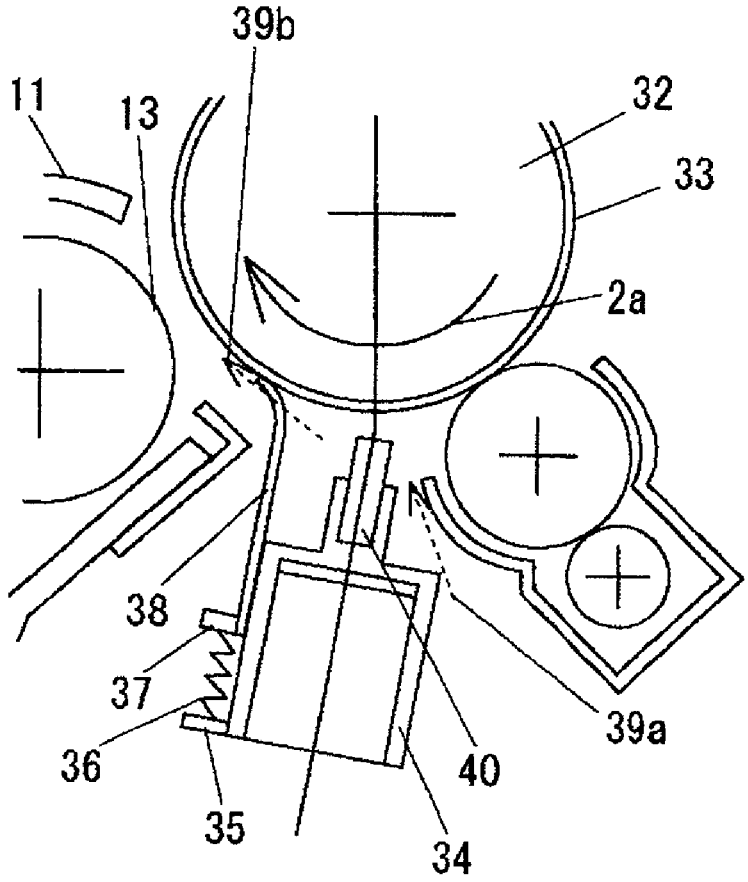
FIG. 6A is a schematic enlarged explanatory diagram showing the periphery of the photosensitive drum of an image forming apparatus according to a second embodiment of the present invention.
Figure 6B:
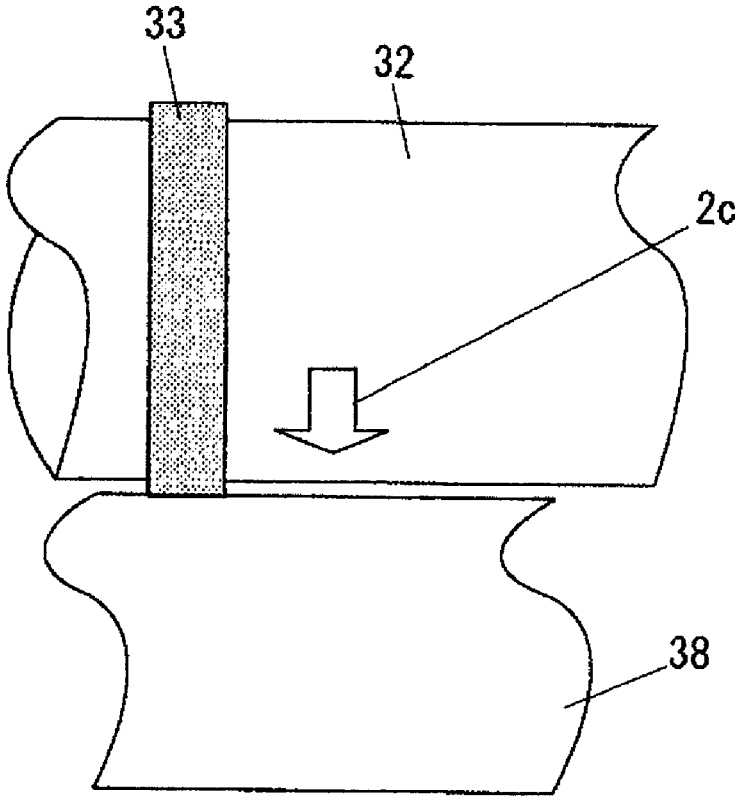
FIG. 6B is a schematic, enlarged explanatory diagram showing the periphery of the photosensitive drum of the image forming apparatus according to the second embodiment.

FIGS. 6A and 6B are enlarged, schematic explanatory diagrams of the periphery of the photosensitive member of the apparatus according to the second embodiment.

It should be noted that in FIG. 6B only a photosensitive member and a toner protection sheet are shown.

In FIGS. 6A and 6B, a latent image is formed and developed, using toner, on a drum shaped photosensitive member 32 that is rotated in the direction indicated by an arrow 2*a* or 2*c*. The photosensitive member 32 is the same as the photosensitive member 1 of the first embodiment, with the exception that toner protection gap members 33 are fitted to a drum (the bare tube of a photosensitive member) at its respective ends (or near its respective ends), which are outside the area (see the image forming area 30 in FIG. 4) in which a latent image is formed and developed using toner.

The toner protection gap members 33 are non-conductive members 5 mm wide and 2 mm thick, made of a material, such as a fluorocoating material, fluorine impregnated porous ceramic or fluorine impregnated sintered copper, that contains, for example, Duracon (registered trademark of Polyplastics Co. Ltd.), Delrin (registered trademark of E.I. du Pont de Nemours and Company), fluorine (4-fluorinated ethylene), polyimide or polyether sulfone (PES). As described above, the toner protection members 33 are securely fitted around the surface at the two ends (or near the two ends) of the drum shaped photosensitive member 32, where they form convex edges.

A fluorine dispersion liquid is employed for the impregnation of fluorine. Or the impregnation of a fluoroplastics liquid may be performed using a non-woven fabric or a polyether or polyester sponge.

An exposure device 34 is the same as the exposure device 4 of the first embodiment, except that a light source cover rib 35, a toner protection pressure spring 36 and a toner protection rib 37, which will be described later, are provided for the outer wall of the exposure device 34.

The light source rib 35 is fixed to the outer wall of the exposure device 34 to hold one end of the toner protection pressure spring 36. The toner protection rib 37 is provided for the outer wall of the exposure device 34, and is also attached to the other end of the toner protection pressure spring 36, so that is moved when the toner protection pressure spring 36 is stretched or contracts. Pressure exerted by the toner protection pressure spring 36 impels the toner protection rib 37 slightly toward the side opposite the light source cover rib 35, i.e., toward the photosensitive member 32.

The toner protection sheet 38, which serves as a dust prevention member, is the same as the toner protection sheet 17 for the first embodiment, except in size. One end of the toner protection sheet 38 is attached to the toner protection rib 37 that it can be moved together with the toner protection rib 37.

In addition, the toner protection sheet 38 is impelled toward the photosensitive member 32 by pressure exerted by the toner protection pressure spring 36. As shown in FIG. 6B, the other end contacts the toner protection gap members 33, and is located near, but does not contact, the photosensitive member 32. With this arrangement of the apparatus, a gap of about 2 mm is defined between the surface of the photosensitive member 32 and the end of the toner protection sheet 38.

The apparatus includes a cooling fan (not shown) for discharging heat generated in the apparatus, and as shown in FIG. 6A, air passages 39*a* and 39*b* are formed around the exposure device 34, so that the air stream generated by the cooling fan passes through these passages 39*a* and 39*b*. In this embodiment, the air passages 39*a* and 39*b* are provided in an area downstream of the air stream, and a location in the apparatus wherein less toner paper lint and other powder-like dust are generated is defined as being upstream of the air stream.

The explanation will be continued while also referring to FIG. 1.

"The location wherein less paper lint and other powder-like dust are generated" corresponds, for example, to a space between the controller 7 and the exposure device 4 in FIG. 1. This portion is separated, by the toner protection sheet 38 (see reference numeral 17 in FIG. 1) and the photosensitive member 32 (see reference numeral 1 in FIG. 1), from other apparatus components, such as the developing device 11, which would most probably cause toner dispersion, and the pickup roller 19, the conveying path 22 and the registration rollers 23, which would most probably generate paper lint. Therefore, air impelled from the pertinent portion includes almost no powder-like dust, such as toner or paper lint.

With the above described arrangement, during the operation of the apparatus, i.e., during electrification of the apparatus, the air stream impelled by the cooling fan always passes around the exposure device 34 in a direction (as indicated by the air passages 39*a* and 39*b*) leading from the lens array 40, which is an optical member, to the photosensitive member 32, which is an image carrier. The air stream indicated by the air passage 39*a* passes between the front face of the lens array 40 of the exposure 34 and the surface of the photosensitive member 32 and continues onward, toward the air passage 39*b*, via the gap between the surface of the photosensitive member 32 and the end of the toner protection sheet 38. In this case, as previously described, since the location wherein less paper lint is generated is defined as being upstream, the state of the air stream is maintained as one wherein there is less paper lint.

When, in this state, the apparatus initiates a printing operation, one end of the toner protection sheet 38 contacts the toner protection gap members 33, which are securely fitted to the surface of the photosensitive member 32, and slides across the surface of the photosensitive member 32 consonant with the rotation of the photosensitive member 32.

Since as described above, the toner protection gap members 33 are members that have been impregnated with fluorine, the toner protection sheet 38 can slide smoothly across the toner protection gap members 33.

Further, by applying the pressure exerted by the toner protection pressure spring 36, the gap between the end of the toner protection sheet 38 and the surface of the photosensitive member 32 is maintained so its height equals the thickness (about 2 mm) of the toner protection gap members 33, and is not unduly affected by the rotation of the photosensitive member 32. Furthermore, the air stream flowing toward the air passage 39*b* is also stably maintained.

As described above, according to the arrangement of the second embodiment, the toner protection sheet 38 is pressed against the toner protection gap members 33 by the toner protection pressure spring 36. However, when the toner protection sheet 38 is sufficiently long, the toner protection sheet 38 may simply be fixed, so that by utilizing its inherent elasticity as a predetermined urging force, the toner protection sheet 38 can also be pushed toward the toner protection gap members 33.

During the printing operation, the developing device 11 employs the developing roller 13 and uses toner to develop a latent image formed on the surface of the photosensitive member 32. Even when toner is dispersed from the developing device 11, the entry of the dispersed toner into the optical path can be almost fully prevented by using the above described air stream. This is also an effective means for preventing the entry of paper lint and other powder-like dust. In this manner, at the front face of the lens array 40, a state can be maintained wherein there is little toner and other powder-like dust, and the attachment of toner and other dust to the surface of the lens can be reduced.

Furthermore, since the toner protection gap members 33, to which a fluoroplastics liquid coating has been applied, are securely fitted at both ends of the photosensitive member 32, toner on the surface of the photosensitive member 32 can be prevented from flowing (leaking) out beyond the ends.

As described above, the end of the toner protection sheet 38 is arranged so it is near, but separated from the surface of the photosensitive member 32 by a predetermined gap. Thus, since the toner protection sheet 38 does not contact the photosensitive member 32, on which a latent image is formed, the toner protection sheet 38 can be used regardless of whether the material of the sheet 38 is conductive. Further, the air passage 39*b* can also be employed as this gap, and the entry of a powder-like dust, such as toner, into the optical path can almost completely be prevented.

Figure 7A:
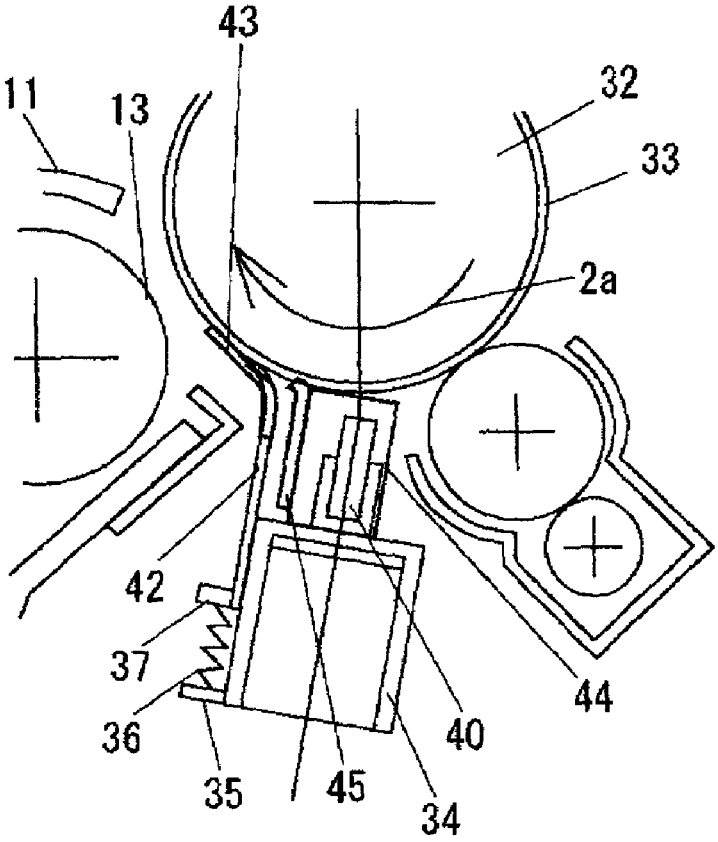
FIG. 7A is an explanatory diagram showing another relevant example according to the second embodiment.
Figure 7B:
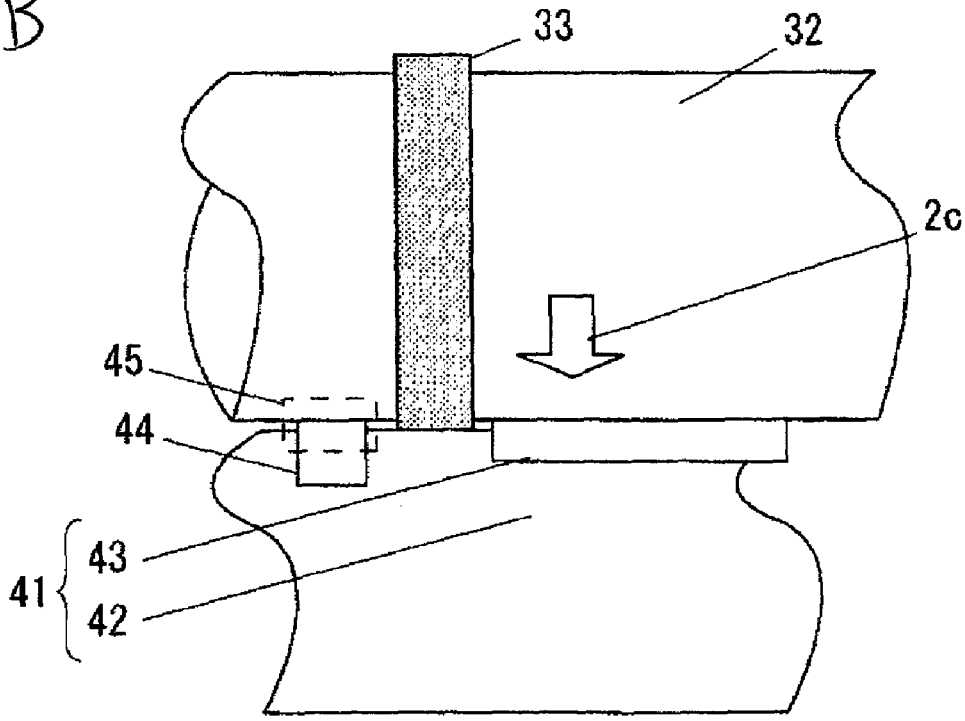
FIG. 7B is an explanatory diagram showing this relevant example according to the second embodiment.

FIGS. 7A and 7B are explanatory diagrams showing another relevant example according to the second embodiment.

In the example shown in FIGS. 6A and 6B, using the toner protection gap members 33 that are fitted around the axial ends of the photosensitive member 32, a predetermined gap is defined by the toner protection sheet 38 relative to the surface of the photosensitive member 32. However, a non-conductive flexible sheet 32, possessing plasticity, may be additionally provided at this portion. In FIGS. 7A and 7B an image forming apparatus is shown that includes such a toner protection sheet. In FIG. 7B, however, only a photosensitive member and a toner protection sheet are shown.

In FIGS. 7A and 7B, a flexible, photosensitive-member-contacting protection member 43 is arranged at the end of the main body 42 of a toner protection sheet 41. The main body 42 is attached to a movable toner protection rib 37, and the entire toner protection sheet 41, including the flexible, photosensitive-member-contacting protection member 43, becomes movable and is urged toward the photosensitive member 32 by pressure exerted by the toner protection pressure spring 36.

Gap adjustment members 44 are anti-sliding members, which are so provided for the exposure device 34 that one end of each gap adjustment member 44 can contact one end (or the vicinity of the end) of a drum (the bare tube of the photosensitive member) outside the image forming area of the photosensitive member 32. With the gap adjustment member 44, a predetermined gap is obtained between the light output face of the lens array 40 and the surface of the photosensitive member 32.

Capillary members 45 are attached to the cap adjustment members 44, downstream, in the rotation direction of the photosensitive member 32, and one end of each slides across the surface of the photosensitive member 32 (or the bare tube). The capillary members 45 are made of a material, such as a felt, non-woven fabric or sponge of communicating holes, which demonstrates a capillary phenomenon and with which a lubricant (fluorine) is impregnated, and through the capillary members 45, the lubricant is supplied to the surface of the photosensitive member 32 (or the bare tube).

The flexible, photosensitive-member-contacting protection member 43 is a non-conductive sheet, possessing plasticity, that is made of a material, such as a fluorocoating material, fluorine impregnated porous ceramic or fluorine impregnated sintered copper, that contains, for example, polyethylene terephthalate (PET), polycarbonate, polyethylene porous film, Duracon (registered trademark of Polyplastics Co. Ltd.), Delrin (registered trademark of E.I. du Pont de Nemours and Company), fluorine (4-fluorinated ethylene), polyimide or polyether sulfone (PES). And the flexible, photosensitive-member-contacting protection member 43 is provided only for the portion that faces the area between the two toner protection gap members 33, on the surface of the photosensitive member 32 that one end contacts. On the other hand, since the end of the main body 42 is pressed against the toner protection gap members 33, the main body 42 does not contact the photosensitive member 32.

As described above, since the toner protection sheet 41 includes the flexible, photosensitive-member-contacting protection member 43, toner dispersed from the developing device 11 can also be prevented from entering the optical path.

At this time, the capillary member 45 can supply the lubricant to the sliding portion of the toner protection gap member 33 that is to be slid by the main body 42 of the toner protection sheet 41. Therefore, abrasion due to the sliding can be suppressed, and a predetermined distance can be maintained between the light output face of the lens array 40 and the surface of the photosensitive member 32. As a result, a focal shift, which is caused by changing the distance between the face of the photosensitive member 32 and the face of the lens array 40, and a reduction in the resolution of an image can also be prevented.

Further, the toner protection sheet 41 need only be a flexible sheet wherein at least the portion contacting the toner protection gap members 33, or the area in the vicinity of that portion, possesses plasticity, and the other portion that does not contact the toner protection gap members 33 may be a metal plate.

Third Embodiment

According to the first and the second embodiments, the image forming apparatus includes a toner protection sheet that provides the following effects. The external face and the area in the vicinity of the optical member can be blocked off from the surroundings, without destroying a latent image formed on the photosensitive member. Furthermore, toner that is dispersed from the developing device and paper lint and other powder-like dust that is dispersed via the sheet conveying system can be almost completely prevented from entering the optical path by passing across the surface of the photosensitive member. In addition, the attachment of powder-like dust to the outer face of the optical member can be reduced.

A third embodiment of the present invention relates to an image forming apparatus (called the apparatus of the third embodiment) that can remove powder-like dust that enters an optical path, even though it is only a tiny amount, and that might especially remain at a location where a toner protection sheet contacts the surface of a photosensitive member.

The main arrangement of the apparatus is substantially the same as the image forming apparatus of the first embodiment, except for a toner protection sheet and the structure of a relevant portion. The image forming operation of the apparatus is also the same as that of the first embodiment. Therefore, in this embodiment, the structures and operations that differ from those of the image forming apparatus of the first embodiment will now be described while referring to FIG. 1.

Figure 8:
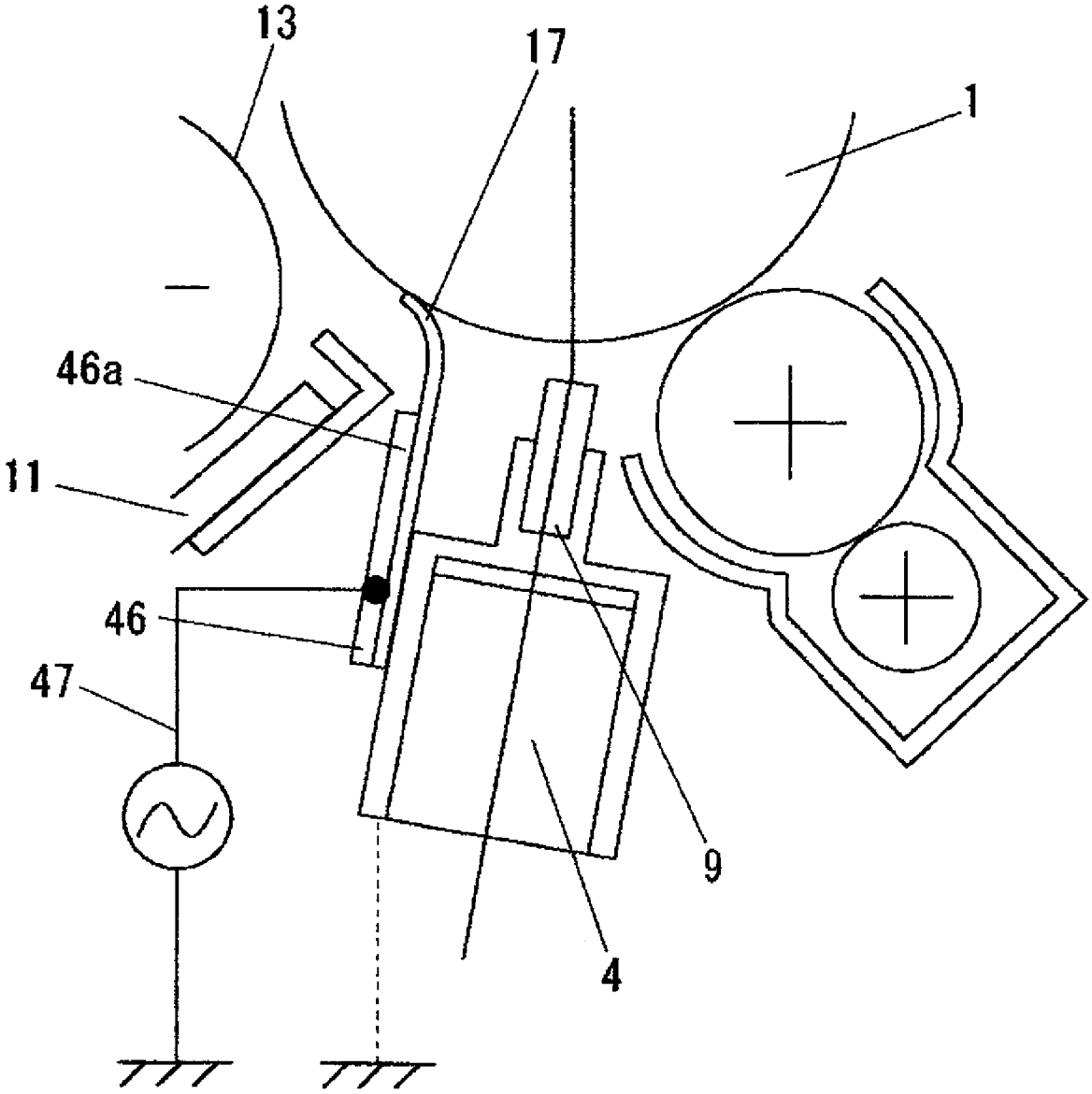
FIG. 8 is a cross sectional view of the peripheral structure of a toner protection sheet provided for an image forming apparatus according to a third embodiment of the present invention.

FIG. 8 is a cross sectional view of the peripheral structure of the toner protection sheet of the apparatus according to the third embodiment.

In FIG. 8, as well as the sheet in the first embodiment, a toner protection sheet 17 is a non-conductive sheet possessing plasticity, and is attached, between a conductive metal plate 46 and the outer face of an exposure device 4, by integrally bonding (electrically connecting) one end of the toner protection sheet 17 to the metal plate 46 along the entire length of a lens array 9.

The face of the metal plate 46, which is bonded together with the toner protection sheet 17, has a metal plate end 46*a* that is not opposite the external face of the exposure device 4, i.e., that does not, with the external face of the external face of the exposure device 4, sandwich the toner protection sheet 17. Since this metal plate end 46*a* is neither supported by, nor contacts any component other than the toner protection sheet 17, the metal plate 46 can be vibrated, at the metal plate end 46*a*, with the toner-protection sheet 17. And the metal plate 46 is electrically insulated from the main body of the apparatus, i.e., is maintained potentially floating, relative to the reference potential of the apparatus, and series as one part of an electric circuit 47 for the apparatus. With this arrangement, a predetermined alternating voltage is to be applied to the metal plate 46 by the controller 7, for a predetermined period of time.

The exposure device 4, by being mounted on % the apparatus, has electrically the same potential as the main body of the apparatus. That is, the exposure device 4 is grounded on the main body of the apparatus.

With the above described arrangement, at an appropriate time in the so-called idle state of an apparatus that is not performing a printing operation, the controller 7 applies an alternating voltage to the metal plate 46. When the alternating voltage is applied to the metal plate 46, the metal plate end 46*a* is vibrated by an alternating-current field generated between the main body of the apparatus and the exposure device 4. Accordingly, the toner protection sheet 17 is also vibrated. Then, even a little powder-like dust that has entered the optical path and has become attached to the toner protection sheet 17, and especially a powder-like dust that has settled on and become attached to the location at which the toner protection sheet 17 contacts the surface of the photosensitive member 1, is separated and removed by the vibration of the toner protection sheet 17.

As described above, when the toner protection sheet 17 is sandwiched between the metal plate that has one end that can be vibrated and the external face of the exposure device, and when the metal plate is vibrated by applying an alternating voltage, powder-like dust attached to the toner protection sheet 17 can be separated and removed.

The arrangement of the third embodiment may be employed, together with the arrangement of the first or second embodiment. In this case, not only can the entry of powder-like dust into the optical path be prevented, but also a small amount of powder-like dust that has become attached to the protection sheet 17 via the optical path, and especially powder-like dust that has settled on and become attached at the location where the toner protection sheet 17 contacts the surface of the photosensitive member 1, can be removed. Therefore, the state wherein there is extremely little powder-like dust in the optical path can be maintained for an extended period of time.

Furthermore, a conductive material is employed for a part or all of the toner protection sheet 17 that contacts the surface of the photosensitive member 1 and that does not contact the external face of the exposure device 4. Further, the toner protection sheet 17 is mounted so that the potential floating state is maintained relative to the reference potential (a so-called ground potential) of the apparatus, i.e., the portion of the toner protection sheet 17 made of a conductive material does not contact (is not grounded on) the main body of the apparatus. With this arrangement, the metal plate 46 is not required. In this case, when an alternating voltage is applied directly to the conductive portion, the conductive portion of the toner protection sheet 17 is vibrated, so that the entire toner protection sheet 17 can be vibrated.

Moreover, according to the arrangement of the third embodiment, the toner protection sheet 17 has been vibrated using a potential difference between the metal plate 46 and the exposure device 4. However, it is more effective when a plate-like piezoelectric device (a piezoelectric device having a so-called bimorph cell structure) is employed instead of the metal plate 46. At this time, the piezoelectric device need not contact the entire toner protection sheet 17, and may contact only one longitudinal portion. With this arrangement, a satisfactory amplitude is obtained at the distal end of the toner protection sheet 17 by applying a voltage, for example, of only ±50 V. Therefore, powder-like dust can be completely removed from the toner protection sheet 17.

Fourth Embodiment

A fourth embodiment of the present invention, as well as the third embodiment, relates to an image forming apparatus (called the apparatus of the fourth embodiment) that can remove even a little powder-like dust that has entered an optical path and that may settled in a location where a toner protection sheet contacts the surface of a photosensitive member.

Since the arrangement of the apparatus is the same as that for the image forming apparatus of the first embodiment, in this embodiment, only operations differing from those of the image forming apparatus of the first embodiment will now be described by also referring to FIGS. 1 and 2.

In addition to a normal printing operation, at an appropriate time in the idle state during which the apparatus is not performing a printing operation, a controller 7 performs a dummy image forming operation for a so-called solid black image (an image, for example, the entire face of which to be printed as a solid black) in order to remove powder-like dust inside an optical path. At this time, it should be noted that a developing device 11 does not perform a developing process using toner, and a transfer roller 15 does not contact a photosensitive member 1.

That is, the controller 7 employs a charge roller 3 to apply a predetermined charge to the photosensitive member 1, and rotates the photosensitive member 1 in the direction indicated by an arrow 2*a* or 2*b*. At this time, for example, a dummy image signal to turn on all the organic EL elements is transmitted to an exposure device 4 to expose the entire surface of the photosensitive member 1 (i.e., a solid black latent image is formed).

At this time, the developing device 11 does not apply a developing bias voltage to the transfer roller 15, and does not perform a developing process for the surface of the photosensitive member 1.

During a period in which this image forming process is performed, toner is not supplied from the developing device 11, although a solid black latent image is formed. Therefore, a little toner that has entered and has been dispersed via the optical path, or toner that has settled in the location where a toner protection sheet 17 contacts the surface of the photosensitive member 1 is easily attracted to the surface of the photosensitive member 1 by the electrostatic force on the solid black image that is formed thereon.

The toner that is electrostatically attracted (corresponds to "being developed") to the surface of the photosensitive member 1 is not transferred by the transfer roller 15, and is removed from the surface of the photosensitive member 1 by the cleaning unit 16.

In the above described example, a so-called solid black latent image is formed on the surface of the photosensitive member 1. However, an image may have a fine mottled pattern (pattern formed by a difference in the potential levels of a latent image), for which the potential of a latent image is repetitively raised or lowered, at a raster cycle, in consonance with the dot cycle of pixels or another cycle, or in which the potential of a latent image is selected at random for each dot of a pixel and is cyclical or non-cyclical in one direction on the surface of the photosensitive member 1.

Therefore, when a latent image having this potential pattern is formed on the photosensitive member 1, and when the photosensitive member 1 is moved while in contact with or while located near the end of the toner protection sheet 17 to which charged toner has become attached, vibration of the potential occurs and the attached toner can be easily removed from the toner protection sheet 17.

The cycle (width) of the latent image potential should at least be larger than a toner particle size. This is because, present among toner trapped on the toner protection sheet 17 is so-called inversely charged toner, and in order to eliminate this toner, an electrostatic potential should be vibrated. Further, in order to separate both the inversely charged toner and positively charged toner from the toner protection sheet 17, and to attract the toner to the photosensitive member 1, an electric flux line having a specific width (area) should be generated.

As described above, formation of a latent image, such as a solid black latent image, is periodically or appropriately performed to obtain a wide range in the direction of a line of intersection in which the photosensitive member contacts the end of the dust prevention member. Therefore, when dust such as toner and paper lint has settled at the portion where the end of the dust prevention member contacts the photosensitive member, the toner or paper lint can be removed by being consumed as a powder material provided for development.

In the first to the fourth embodiment, a photosensitive member having a drum shape has been employed. However, a photosensitive member need not be a drum type, and may be a belt type.

As described above in detail, the first embodiment to the fourth embodiment include the following aspects.

According to one aspect of the invention, an image forming apparatus comprises:

an image carrier, for carrying a latent image;

an exposure device, for forming a latent image on the image carrier, that includes a light source, and an optical member, for focusing light emitted by the light source on the image carrier, a developing device, for developing the latent image, and a dust prevention member, provided for the exposure device to contact the image carrier.

With this arrangement of the apparatus, especially the arrangement wherein the exposure device is located close to the image carrier, although the dust prevention member contacts the surface of the image carrier, charges placed on the surface of the image carrier when forming a latent image are not disturbed (discharged). Thus, the latent image is not destroyed, and the outer face and the vicinity of the optical member can be blocked off from the surrounding area. Moreover, toner dispersed from the developing device, and paper lint and other powder-like dust dispersed by the conveying system can be substantially prevented from entering the optical path by passing across the surface of the image carrier. In addition, the attachment of powder-like dust to the external face of the optical member can be suppressed. As a result, the deterioration of image quality, which is accompanied by a reduction in the accuracy of the exposure optical system, can be prevented.

According to another aspect of the invention, an image forming apparatus, which forms a visible image developed using toner or another powder material, comprises:

an image carrier, such as a photosensitive member, on the surface of which a latent image is formed by exposure and is to be held thereon and developed using a powder material;

an exposure device, including a light source, for outputting light from the light source through an optical member, such as a lens, to expose the surface of the image carrier; and a developing device, for developing the latent image on the surface of the image carrier using the powder material, wherein a dust prevention member is provided that has a film form, at least one face of which is located between the optical member and the developing device, and includes a non-conductive end of the face that contacts the surface of the image carrier, wherein, on the developing device side face of an optical path along which light is passed from the optical member, at least one area that contacts an outer face of the optical member, in the light axial direction of the optical path, is protected from powder-like dust dispersion.

With this arrangement of the image forming apparatus, especially the arrangement wherein the exposure device is located close to the image carrier, although the dust prevention member contacts the surface of the image carrier, charges placed on the surface of the image carrier when forming a latent image are not disturbed (discharged). Thus, the latent image is not destroyed, and the outer face and the vicinity of the optical member can be blocked off from the surrounding area. Moreover, toner dispersed from the developing device, and paper lint and other powder-like dust dispersed by the conveying system can be substantially prevented from entering the optical path by passing across the surface of the image carrier. In addition, the attachment of powder-like dust to the external face of the optical member can be suppressed. As a result, the deterioration of image quality, which is accompanied by a reduction in the accuracy of the exposure optical system, can be prevented.

Further, for the image forming apparatus of the invention, one part of the dust prevention member is made of a conductive material, and the dust prevention member is mounted so that a potential floating state is maintained relative to a reference potential for the image forming apparatus.

With this arrangement, the use of the dust prevention member is enabled, even though it is made of a conductive material.

Furthermore, for the image forming apparatus of the invention, at least the end of the dust prevention member is made of a flexible material, and one tip of the end is slid across the surface of the image carrier.

With this arrangement, contact of the end of the dust prevention member with the surface of the image carrier is more stable. Therefore, toner dispersed from the developing device can be substantially prevented from entering the optical path from the contacting portion. Therefore, deterioration in the image quality, which is accompanied by a reduction in the accuracy of the exposure optical system, can be prevented.

For the image forming apparatus of the invention, at least during a development process, the image carrier is rotated, so that the direction in which the end of the dust prevention member, or a face extended from the end, intersects the surface of the image carrier is not perpendicular to the direction in which the image carrier is rotated.

With this arrangement, as the image carrier is rotated, dispersed powder-like dust can be moved to one side or to both sides of the end of the dust prevention member that contacts, or is located near the image carrier. Therefore, the settling of powder-like dust in an area wherein a latent image is formed and developed can be eliminated.

Further, for the image forming apparatus of this invention, at least a part of the end of the dust prevention member is arranged near, but separated from the image carrier by a predetermined gap.

With this arrangement, since the dust prevention member does not contact the image carrier, the usage of the dust prevention member is enabled, regardless of whether a conductive material is employed. Further, the gap may be defined as an air passage.

For the image forming apparatus of the invention, an area of the surface of the image carrier where image forming is not performed is a convex portion, and the dust prevention member contacts the convex portion.

With this arrangement, easily and stably, with a predetermined gap, the end of the dust prevention member can at least be brought near the convex portion of the image carrier.

For the image forming apparatus of the invention, along the optical path of light emitted by the exposure device that is located near the dust prevention member, an air passage is formed so that an air stream flows in the direction from the optical member to the surface of the image carrier.

With this arrangement, dispersed powder-like dust can be prevented from approaching the optical member, and can be held at a distance from the optical member.

For the image forming apparatus of the invention, the developing-device-side face at the end of the dust prevention member is made of a material or is a member that has a larger specific gravity than an optical-member-side face.

With this arrangement, during a development process, when the image carrier is rotated from the optical member side to the developing device side, the raising of the end of the dust prevention member is avoided. Therefore, toner dispersed from the developing device can be prevented from entering the optical path through a gap that is formed at the end. Further, the deterioration in the image quality that is accompanied by a reduction in the accuracy of the exposure optical system can be prevented.

For the image forming apparatus of the invention, the end of the dust prevention member on the developing device side is made of a metal or another conductive material.

With this arrangement, the developing-device-side face at the end of the dust prevention member can have a greater specific gravity than the optical-member-side face. In addition, an alternating voltage or an alternating current field can be applied to the conductive portion. Thus, a structure that vibrates the end can also be easily obtained.

For the image forming apparatus of the invention, the direction in which the outer wall of the optical member faces the image carrier, or the light axial direction of light output by the optical member is opposite the side on which the developing device is located.

With this arrangement, the guiding of dispersed powder-like dust to the optical path, and the attachment of dust to the outer wall of the optical member can be prevented more effectively.

Furthermore, for the image forming apparatus of the embodiment, a gap adjustment member is located between the image carrier and the exposure device, so as to maintain a predetermined distance between the surface of the image carrier and the front face of the optical member.

In addition, the gap adjustment member has an anti-sliding function, and is to contact an area of the image carrier on which an image is not formed.

According to this arrangement, without destroying an image formed on a rotary image carrier, a predetermined distance can be obtained between the front face of the optical member and the surface of the image carrier. Further, a focal shift due to a change in a distance, and an accompanying deterioration in image resolution can be prevented.

For the image forming apparatus of the invention, a lubricant is supplied to a part of the surface of the image carrier on which an image is not formed.

With this arrangement, abrasion of the image carrier, the dust prevention member and the gap adjustment member and another sliding member is suppressed, and the functions and performances of the individual components can be maintained for an extended period of time.

For the image forming apparatus of the invention, in order to remove powder-like dust, formation of a latent image is appropriately performed to obtain a wide range in the direction of a line of intersection in which the photosensitive member contacts the end of the dust prevention member.

With this arrangement, when toner or powder-like dust has settled in a location where the end of the dust prevention member contacts the surface of the photosensitive member, the toner or the powder-like dust can be removed from this the location by being consumed as a powder material that is provided for development.

In addition, for the image forming apparatus of the invention, a latent image formed on the surface of the image carrier has a fine mottled pattern that is cyclic, or non-cyclic in one direction of the surface of the image carrier.

A latent image formed on the surface of the image carrier has a fine mottled pattern (a pattern formed by raising and lowering the potential of a latent image) that is cyclic or non-cyclic in one direction of the surface of the image carrier, e.g., a pattern in which the potential is repetitively raised and lowered in accordance with a raster cycle. Thus, when a latent image having this potential pattern is formed on the photosensitive member (the image carrier), and when the image carrier is moved while contacting or being located near the end of the dust prevention member to which charged toner has become attached, vibration of the potential occurs, and the attached toner can be easily removed from the dust prevention member.

For the image forming apparatus of the invention, development by the developing device is not performed when a latent image is formed to remove powder-like dust.

With this arrangement, since toner is not supplied by the developing device, a latent image formed on the surface of the photosensitive member is not developed using toner, i.e., a latent image is maintained without the electrostatic discharge being performed. Further, a small amount of dispersed toner, which has entered the optical path and has settled on the portion of the dust prevention member that contacts the surface of the photosensitive member, is easily attracted by the electrostatic force of the latent image. Thus, toner in the optical path can be effectively removed.

For the image forming apparatus of the invention, the dust prevention member is provided for the exposure device, on both upstream and downstream sides, in a direction in which the image carrier is rotated relative to the exposure device.

With this arrangement, almost the entire exposure device is enclosed by the dust prevention member, and the dust prevention effects can be considerably improved. In this case, the two longitudinal ends of the exposure device are open. However, since the exposure device is compactly made, less powder-like dust can enter through the open ends.

According to another aspect of the invention, an image forming apparatus, which forms a visible image developed using toner or another powder material, comprises:

an image carrier, such as a photosensitive member, on the surface of which a latent image is formed by exposure and is to be held and developed using a powder material;

an exposure device, including a light source, for outputting light produced by the light source through an optical member, such as a lens, to expose the surface of the image carrier; and a developing device, for developing the latent image on the surface of the image carrier using the powder material; and a dust prevention member in a film form, wherein at least one face of the dust prevention member is located between the optical member and the developing device, and one end of the face is brought into contact with, or near, the face of the image forming member, wherein, of the developing device side faces of an optical path along which light from the optical member passes, at least one area that contacts an outer face of the optical member in the light axial direction of the optical path is protected from dispersion of powder-like dust, and wherein at least one portion, of the end of the dust prevention member, that does not contact the surface of the image carrier is made of a conductive material, so that the dust prevention member is to be vibrated by applying, to the portion, an alternating voltage or an alternating current field.

With this arrangement of the image forming apparatus, especially the arrangement wherein the exposure device is arranged near the image carrier, the outer face and the vicinity of the optical member can be blocked off from the surroundings. Moreover, toner dispersed from the developing device, and paper lint and other powder-like dust dispersed from the sheet conveying system can substantially be prevented from being attached to the external face of the optical member. In addition, powder-like dust that is attached to the dust prevention member, or that settles in the vicinity, can be separated and removed by vibration of the dust prevention member. Therefore, deterioration in the image quality that is accompanied by a reduction in the accuracy of the exposure optical system can be suppressed. In addition, a manual operation performed by a maintenance man, such as cleaning to remove powder-like dust that has become attached or has settled, is not required, and overall satisfactory accuracy can be maintained for the image quality for an extended period of time.

According to an additional aspect of the invention, an exposure device, which is used in an image forming apparatus that includes: an image carrier, such as a photosensitive member, on the surface of which a latent image is formed by exposure and is to be held and developed using toner or another powder material; and a developing device, which develops, using a powder material, a latent image that is formed on the surface of the image carrier and provides a visible image, comprises:

a light source, for emitting light;

a lens and another optical member, for outputting light emitted by the light source to expose the surface of the image carrier;

a film-like dust prevention member, for blocking dispersion of powder-like dust for at least one part of a developing-device-side of an optical path of light that is output by the optical member, that contacts the external wall of the optical member in the light axial direction of the optical path, wherein, when the exposure device is mounted in the image forming apparatus, at least one face of the dust prevention member is located between the optical member and the developing device, and one end of the face is made of a conductive material and contacts the surface of the image carrier.

With this arrangement, although the dust prevention member, provided for the exposure device, contacts the surface of the image carrier, charges placed on the surface of the image carrier when forming a latent image are not disturbed (discharged). Thus, the latent image is not destroyed, and the outer face and the vicinity of the optical member can be blocked off from the surrounding area. Moreover, toner dispersed from the developing device, and paper lint and other powder-like dust dispersed by the conveying system can be substantially prevented from entering the optical path by passing across the surface of the image carrier. In addition, the attachment of powder-like dust to the external face of the optical member can be suppressed, and as a result, the a reduction in the accuracy of the exposure optical system can be prevented.

According to one more aspect of the invention, an exposure device, which is used in an image forming apparatus that includes: an image carrier, such as a photosensitive member, on the surface of which a latent image is formed by exposure and is to be held and developed using toner or another powder material; and a developing device, which develops, using a powder material, a latent image that is formed on the surface of the image carrier and provides a visible image, comprises:

a light source, for emitting light;

a lens and another optical member, for outputting light emitted by the light source to expose the surface of the image carrier;

a film-like dust prevention member, for blocking dispersion of powder-like dust for at least one part of a developing-device-side of an optical path of light that is output by the optical member, that contacts the external wall of the optical member in the light axial direction of the optical path, wherein, when the exposure device is mounted in the image forming apparatus, at least one face of the dust prevention member is located between the optical member and the developing device, and one end of the face contacts, or is located close to the surface of the image carrier, and wherein at least one portion, of the end of the dust prevention member, that does not contact the surface of the image carrier is made of a conductive material, so that the dust prevention member is to be vibrated by applying, to the portion, an alternating voltage or an alternating current field.

With this arrangement of the image forming apparatus, especially the arrangement wherein the exposure device is arranged near the image carrier, the outer face and the vicinity of the optical member can be blocked off from the surroundings. Moreover, toner dispersed from the developing device, and paper lint and other powder-like dust dispersed from the sheet conveying system can substantially be prevented from being attached to the external face of the optical member. In addition, powder-like dust that is attached to the dust prevention member, or that settles in the vicinity, can be separated and removed by vibration of the dust prevention member. Therefore, deterioration in the image quality that is accompanied by a reduction in the accuracy of the exposure optical system can be suppressed. In addition, a manual operation performed by a maintenance man, such as cleaning to remove powder-like dust that has become attached or has settled, is not required, and overall satisfactory accuracy can be maintained for the image quality for an extended period of time.

For the image forming apparatus of the invention, a light source is elongated.

With this arrangement, since the exposure device can be arranged near the image carrier that is to be irradiated, the image forming apparatus can be compactly made.

For the image forming apparatus of the invention, a light emitting array of a plurality of light emitting members is provided as the light source. With this arrangement, scanning using light emitted by the exposure device can be performed by controlling the light emission timing of each light emitting member. Therefore, since a function related to optical scanning can be obtained without a mechanical member being required, the size of the exposure device can be reduced.

INDUSTRIAL APPLICABILITY

The image forming apparatus of this invention can be employed as a printer, a facsimile machine, a copier, or another electrophotographic output apparatus for a data processing apparatus, and the exposure device of the invention can be employed for such an image forming apparatus.

This application is based upon and claims the benefit of priority of Japanese Patent Application No. 2006-201582 filed on Jul. 25, 2006, the contents of which are incorporated herein by reference in its entirety.

[FIG. 1]
1: PHOTOSENSITIVE MEMBER
3: CHARGING ROLLER
4: EXPOSURE DEVICE
7: CONTROLLER
8: EXTERNAL INTERFACE
9: LENS ARRAY
11: DEVELOPMENT DEVICE
12: SUPPLY ROLLER
13: DEVELOPMENT ROLLER
15: TRANSFER ROLLER
17: TONER PROTECTION SHEET
18: SHEET CASSETTE
19: PICKUP ROLLER
20: FEED ROLLER
21: PRINTING SHEET
22: CONVEYING PATH
23: REGISTRATION ROLLER
24: FIXING ROLLER
25: DISCHARGE TRAY
[FIG. 2]
1: PHOTOSENSITIVE MEMBER
3: CHARGING ROLLER
4: EXPOSURE DEVICE
5: AXIS
6: SUBSTRATE
9: LENS ARRAY
10: LIGHT AXIS
11: DEVELOPMENT DEVICE
12: SUPPLY ROLLER
13: DEVELOPMENT ROLLER
14: BLADE
15: TRANSFER ROLLER
16: CLEANING UNIT
17: TONER PROTECTION SHEET
[FIG. 3]
1: PHOTOSENSITIVE MEMBER
3: CHARGING ROLLER
4: EXPOSURE DEVICE
6: SUBSTRATE:
9: LENS ARRAY
11: DEVELOPMENT DEVICE
13: DEVELOPMENT ROLLER
17: TONER PROTECTION SHEET
[FIG. 4]
1: PHOTOSENSITIVE MEMBER
5: AXIS
9: LENS ARRAY
26: TONER PROTECTION SHEET
27: TONER PROTECTION SHEET
29*a*, 29*b*: END
30: IMAGE FORMING AREA
[FIG. 5]
1: PHOTOSENSITIVE MEMBER
4: EXPOSURE DEVICE
9: LENS ARRAY
11: DEVELOPMENT DEVICE
13: DEVELOPMENT ROLLER
31, 31*a*, 31*b*: TONER PROTECTION SHEET
[FIG. 6]
11: DEVELOPMENT DEVICE

13: DEVELOPMENT ROLLER
32: PHOTOSENSITIVE MEMBER
33: TONER PROTECTION GAP MEMBER
34: EXPOSURE DEVICE
35: LIGHT SOURCE COVER RIB
36: TONER PROTECTION PRESSURE SPRING
37: TONER PROTECTION RIB
38: TONER PROTECTION SHEET
39*a*, 39*b*: AIR PASSAGE
40: LENS ARRAY
[FIG. 7]
11: DEVELOPMENT DEVICE
13: DEVELOPMENT ROLLER
32: PHOTOSENSITIVE MEMBER
33: TONER PROTECTION GAP MEMBER
34: EXPOSURE DEVICE
35: LIGHT SOURCE COVER RIB
36: TONER PROTECTION PRESSURE SPRING
37: TONER PROTECTION RIB
40: LENS ARRAY
41: TONER PROTECTION SHEET
42: MAIN BODY
43: FLEXIBLE PHOTOSENSITIVE-MEMBER-CONTACTING PROTECTION MEMBER
44: GAP ADJUSTMENT MEMBER
45: CAPILLARY MEMBER
[FIG. 8]
1: PHOTOSENSITIVE MEMBER
4: EXPOSURE DEVICE
9: LENS ARRAY
11: DEVELOPMENT DEVICE
13: DEVELOPMENT ROLLER
17: TONER PROTECTION SHEET
46: METAL PLATE
46*a*: METAL PLATE END
47: ELECTRIC CIRCUIT

What is claimed is:

1. An image forming apparatus comprising:
an image carrier for carrying a latent image;
an exposure device including a light source, and an optical member for focusing light emitted by the light source on the image carrier for forming a latent image on the image carrier;
a developing device for developing the latent image; and
a dust prevention member provided to the exposure device to contact the image carrier, wherein a lubricant is supplied to a part of a surface of the image carrier on which an image is not formed.

2. The image forming apparatus according to claim 1, wherein one part of the dust prevention member is made of a conductive material, and the dust prevention member is mounted so that a potential floating state is maintained relative to a reference potential for the image forming apparatus.

3. The image forming apparatus according to claim 1, wherein at least an end of the dust prevention member is made of a flexible material, and one tip of the end is slid on the surface of the image carrier.

4. The image forming apparatus according to claim 1, wherein, at least during a development process, the image carrier is rotated, so that the direction in which the end of the dust prevention member, or a face extended from the end, intersects the surface of the image carrier is not perpendicular to the direction in which the image carrier is rotated.

5. The image forming apparatus according to claim 1, wherein at least a part of the end of the dust prevention member is arranged near the image carrier with a predetermined gap.

6. The image forming apparatus according to claim 5, wherein a part of an area of the surface of the image carrier where image forming is not performed is a convex portion, and the dust prevention member contacts the convex portion.

7. The image forming apparatus according to claim 5, wherein, in the optical path of light emitted by the exposure device that is located near the dust prevention member, an air passage is formed so that an air stream flows in the direction from the optical member to the surface of the image carrier.

8. The image forming apparatus according to claim 1, wherein a developing-device-side face at the end of the dust prevention member is made of a material that has a larger specific gravity than an optical-member-side face of the dust prevention member.

9. The image forming apparatus according to claim 8, wherein a conductive material is employed as the material that serves as the developing-device-side face at the end of the dust prevention member.

10. The image forming apparatus according to claim 1, wherein the direction in which an outer wall of the optical member faces the image carrier, or the light axial direction of light output by the optical member, is opposite the side on which the developing device is located.

11. The image forming apparatus according to claim 1, wherein a gap adjustment member is located between the image carrier and the exposure device, so as to maintain a predetermined distance between the surface of the image carrier and a front face of the optical member, and
wherein the gap adjustment member has an anti-sliding function, and is to contact an area of the image carrier on which an image is not formed.

12. The image forming apparatus according to claim 1, wherein formation of the latent image on the surface of the image carrier covers a wide range in the direction of a line of intersection in which the image carrier contacts the end of the dust prevention member in order to remove powder-like dust.

13. The image forming apparatus according to claim 12, wherein the latent image formed on the surface of the image carrier has a fine mottled pattern that is cyclic, or non-cyclic in one direction of the surface of the image carrier.

14. The image forming apparatus according to claim 12, wherein development by the developing device is not performed when the latent image is formed to remove powder-like dust.

15. The image forming apparatus according to claim 1, wherein the dust prevention member is provided for the exposure device, on both upstream and downstream sides, in a direction in which the image carrier is rotated relative to the exposure device.

16. An image forming apparatus for forming a visible image developed using a powder material, comprising:
an image carrier having a surface for carrying a latent image formed by exposure;
an exposure device including a light source for outputting light through an optical member to expose the surface of the image carrier;
a developing device for developing the latent image on the surface of the image carrier using the powder material; and
a film dust prevention member including one face located between the optical member and the developing member, the one face including a non-conductive end that contacts the surface of the image carrier,
wherein the dust prevention member protects a developing device side face of an optical path along which light is passed from the optical member, wherein the dust prevention member protects at least a part of an area that contacts an outer face of the optical member in the light axial direction of the optical path, and wherein a lubricant is supplied to a part of the surface of the image carrier on which an image is not formed.

17. The image forming apparatus according to claim 16, wherein one part of the dust prevention member is made of a conductive material, and the dust prevention member is mounted so that a potential floating state is maintained relative to a reference potential for the image forming apparatus.

18. The image forming apparatus according to claim 16, wherein at least the end of the dust prevention member is made of a flexible material, and one tip of the end is slid on the surface of the image carrier.

19. The image forming apparatus according to claim 16, wherein, at least during a development process, the image carrier is rotated, so that the direction in which the end of the dust prevention member that contacts the surface of the image carrier is not perpendicular to the direction in which the image carrier is rotated.

20. The image forming apparatus according to claim 16, wherein at least a part of the end of the dust prevention member is arranged near the image carrier with a predetermined gap.

21. The image forming apparatus according to claim 20, wherein a part of an area of the surface of the image carrier where image forming is not performed is a convex portion, and the dust prevention member contacts the convex portion.

22. The image forming apparatus according to claim 20, wherein, in the optical path of light emitted by the exposure device that is located near the dust prevention member, an air passage is formed so that an air stream flows in the direction from the optical member to the surface of the image carrier.

23. The image forming apparatus according to claim 16, wherein a developing-device-side face at the end of the dust prevention member is made of a material that has a larger specific gravity than an optical-member-side face of the dust prevention member.

24. The image forming apparatus according to claim 23, wherein a conductive material is employed as the material for, or the member that serves as the developing-device-side face at the end of the dust prevention member.

25. The image forming apparatus according to claim 16, wherein the direction in which an outer wall of the optical member faces the image carrier, or the light axial direction of light output by the optical members is opposite the side on which the developing device is located.

26. The image forming apparatus according to claim 16, wherein a gap adjustment member is located between the image carrier and the exposure device, so as to maintain a predetermined distance between the surface of the image carrier and a front face of the optical member, and wherein the gap adjustment member has an anti-sliding function, and is to contact an area of the image carrier on which an image is not formed.

27. The image forming apparatus according to claim 16, wherein formation of the latent image on the surface of the image carrier covers a wide range in the direction of a line of intersection in which the image carrier contacts the end of the dust prevention member in order to remove powder-like dust.

28. The image forming apparatus according to claim 27, wherein the latent image formed on the surface of the image carrier has a fine mottled pattern that is cyclic, or non-cyclic in one direction of the surface of the image carrier.

29. The image forming apparatus according to claim 27, wherein development by the developing device is not performed when the latent image is formed to remove powder-like dust.

30. The image forming apparatus according to claim 16, wherein the dust prevention member is provided for the exposure device, on both upstream and downstream sides, in a direction in which the image carrier is rotated relative to the exposure device.

31. An image forming apparatus, which forms a visible image developed using powder material, comprising:

an image carrier having a surface for carrying a latent image formed by exposure;

an exposure device including a light source for outputting light through an optical member to expose the surface of the image carrier;

a developing device for developing the latent image on the surface of the image carrier using the powder material; and a film dust prevention member including one face located between the optical member and the developing member, the one face including a non-conductive end that contacts the surface of the image carrier, wherein the dust prevention member protects a developing device side face of an optical path along which light is passed from the optical members wherein the dust prevention member protects at least a part of an area that contacts an outer face of the optical member in the light axial direction of the optical path, and wherein at least one portion, of the end of the dust prevention member, that does not contact the surface of the image carrier is made of a conductive material, and the dust prevention member is configured to be vibrated by applying to the portion an alternating voltage or an alternating current field.

* * * * *

UNITED STATES PATENT AND TRADEMARK OFFICE

CERTIFICATE OF CORRECTION

PATENT NO. : 7,684,725 B2
APPLICATION NO. : 11/782156
DATED : March 23, 2010
INVENTOR(S) : K. Suyama et al.

It is certified that error appears in the above-identified patent and that said Letters Patent is hereby corrected as shown below:

At column 27, lines 41 and 42 (Claim 24, lines 2 & 3) of the printed patent, delete "for, or the member" before "that".

At column 27, line 47 (claim 25, line 4) of the printed patent, "members" should be --member,--.

At column 28, line 40 (claim 31, line 17) of the printed patent, "members" should be --member--.

Signed and Sealed this

Seventh Day of September, 2010

David J. Kappos

David J. Kappos
*Director of the United States Patent and Trademark Office*